US011034122B2

(12) United States Patent
Ruhland et al.

(10) Patent No.: US 11,034,122 B2
(45) Date of Patent: Jun. 15, 2021

(54) SYSTEM FOR PRODUCING CORRUGATED CARDBOARD

(71) Applicant: BHS Corrugated Maschinen- und Anlagenbau GmbH, Weiherhammer (DE)

(72) Inventors: Karl Ruhland, Pfreimd (DE); Michael Dehling, Sulzbach-Rosenberg (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 221 days.

(21) Appl. No.: 16/305,632

(22) PCT Filed: May 30, 2017

(86) PCT No.: PCT/EP2017/063008

§ 371 (c)(1),
(2) Date: Nov. 29, 2018

(87) PCT Pub. No.: WO2017/207551

PCT Pub. Date: Dec. 7, 2017

(65) Prior Publication Data

US 2020/0331226 A1 Oct. 22, 2020

(30) Foreign Application Priority Data

May 31, 2016 (DE) ..... 10 2016 209 388.6

(51) Int. Cl.
*B31F 1/28* (2006.01)

(52) U.S. Cl.
CPC ..... *B31F 1/2813* (2013.01); *B31F 1/2831* (2013.01); *B31F 1/2818* (2013.01); *B31F 1/2822* (2013.01); *B31F 1/2877* (2013.01); *B65H 2701/1762* (2013.01)

(58) Field of Classification Search
CPC ..... B31F 1/28; B31F 1/2868
See application file for complete search history.

(56) References Cited

U.S. PATENT DOCUMENTS 4,190,478 A 2/1980 Meisenberg
5,368,252 A 11/1994 Biagiotti
(Continued)

FOREIGN PATENT DOCUMENTS

CN 1095353 A 11/1994
DE 1 196 063 B 7/1965
(Continued)

*Primary Examiner* — Barbara J Musser
(74) *Attorney, Agent, or Firm* — McGlew and Tuttle, P.C.

(57) ABSTRACT

A plant for producing corrugated cardboard. The plant includes an arrangement for producing a corrugated cardboard web laminated on one side, the arrangement having a corrugating apparatus for generating a corrugated web, which has a corrugation, from a first material web, having a glue-applying apparatus for applying glue to tips of the corrugation of the corrugated web, and having a pressing apparatus for pressing a top web onto the tips, provided with glue, of the corrugated web. The plant furthermore has a severing apparatus which is arranged upstream of the corrugating apparatus and which serves for at least regionally severing the first material web in the transverse direction thereof.

21 Claims, 17 Drawing Sheets

(56) References Cited

U.S. PATENT DOCUMENTS

| | | | | |
|---|---|---|---|---|
| 5,542,622 | A * | 8/1996 | Biagiotti ..... | B65H 19/2269 242/521 |
| 2006/0219072 | A1 | 10/2006 | Tynkkynen et al. | |
| 2011/0311750 | A1 | 12/2011 | McNeil et al. | |

FOREIGN PATENT DOCUMENTS

| | | | |
|---|---|---|---|
| DE | 2119456 | A1 | 10/1972 |
| DE | 27 48 675 | C2 | 3/1979 |
| DE | 81 07 184 | U1 | 7/1982 |
| DE | 36 30 556 | A1 | 3/1988 |
| DE | 36 31 803 | A1 | 3/1988 |
| DE | 36 35 626 | C1 | 4/1988 |
| DE | 36 35 638 | C1 | 4/1988 |
| DE | 37 02 391 | A1 | 8/1988 |
| DE | 93 04 390 | U1 | 6/1993 |
| DE | 4334094 | A1 | 4/1995 |
| DE | 44 25 155 | A1 | 1/1996 |
| DE | 199 10 570 | A1 | 9/2000 |
| DE | 200 15 095 | U1 | 12/2000 |
| DE | 600 08 322 | T2 | 5/2005 |
| DE | 10 2006 012 352 | A1 | 10/2006 |
| EP | 2067584 | A1 | 6/2009 |
| JP | S61 152398 | A | 7/1986 |
| WO | 2015150452 | A1 | 10/2015 |

* cited by examiner

SYSTEM FOR PRODUCING CORRUGATED CARDBOARD

CROSS REFERENCE TO RELATED APPLICATIONS

This application is a United States National Phase Application of International Application PCT/EP2017/063008 filed May 30, 2017 and claims the benefit of priority under 35 U.S.C. § 119 of German Patent Application, Serial No. DE 10 2016 209 388.6 filed May 31, 2016, the entire contents of which are incorporated herein by reference.

FIELD OF THE INVENTION

The invention relates to a plant for producing corrugated cardboard. The invention is also directed to an arrangement for producing an, in particular endless, corrugated cardboard web laminated on one side, as a constituent part of a plant of said type.

BACKGROUND OF THE INVENTION

Various plants for producing corrugated cardboard are already known from the prior art as a result of prior public use.

DE 36 35 638 C1, DE 36 30 556 A1, DE 36 35 626 C1, DE 1 196 063 A and DE 44 25 155 A1 and also DE 27 48 675 C2 disclose generic corrugated cardboard plants.

SUMMARY OF THE INVENTION

The invention is based on the object of providing an improved plant for producing corrugated cardboard. It is furthermore sought to create a correspondingly improved arrangement for producing a corrugated cardboard web laminated on one side.

Said object is achieved according to the invention by means of a plant for producing corrugated cardboard, having an arrangement for producing a corrugated cardboard web laminated on one side, said arrangement comprising a corrugating apparatus for generating a corrugated web, which has a corrugation, from a first material web, a glue-applying apparatus for applying glue to tips of the corrugation of the corrugated web, and a pressing apparatus for pressing a top web onto the tips, provided with glue, of the corrugated web, and having a severing apparatus which is arranged upstream of the corrugating apparatus and which serves for at least regionally severing the first material web in the transverse direction thereof.

Furthermore, said object is achieved by means of an arrangement for producing a corrugated cardboard web laminated on one side, as a constituent part of a plant for producing corrugated cardboard, comprising a corrugating apparatus for generating a corrugated web, which has a corrugation, from a first material web, a glue-applying apparatus for applying glue to tips of the corrugation of the corrugated web, a pressing apparatus for pressing a top web onto the tips, provided with glue, of the corrugated web, and a severing apparatus which is arranged upstream of the corrugating apparatus and which serves for at least regionally severing the first material web in the transverse direction thereof.

Furthermore, said object is achieved by means of a method for producing corrugated cardboard, comprising the steps producing a corrugated cardboard web laminated on one side by means of an arrangement for producing a corrugated cardboard web laminated on one side, which arrangement comprises a corrugating apparatus for generating a corrugated web, which has a corrugation, from a first material web, a glue-applying apparatus for applying glue to tips of the corrugation of the corrugated web, and a pressing apparatus for pressing a top web onto the tips, provided with glue, of the corrugated web, and at least regionally severing the first material web in the transverse direction thereof upstream of the corrugating apparatus by means of a severing apparatus.

Finally, said object is achieved by means of a plant for producing corrugated cardboard, having an arrangement for producing a corrugated cardboard web laminated on one side, said arrangement comprising a corrugating apparatus for generating a corrugated web, which has a corrugation, from a first material web, a glue-applying apparatus for applying glue to tips of the corrugation of the corrugated web, and a pressing apparatus for pressing a top web onto the tips, provided with glue, of the corrugated web, and having a severing apparatus for at least regionally severing the first material web in the transverse direction thereof upstream of the corrugating apparatus.

The essence of the invention lies in the fact that a severing apparatus is provided, by means of which the first material web, or the corrugated web formed from the first material web, can be at least regionally severed.

In the case of the first material web being completely severed, if an leading web section, thus generated, of the first material web is transported onward, empty running of the arrangement for producing a corrugated cardboard web laminated on one side occurs. For example, at least one component of the arrangement for producing a corrugated cardboard web laminated on one side, also referred to as single face, in particular the corrugating apparatus, is very easily exchangeable and/or repairable.

The severing apparatus is for example capable of at least regionally severing the first material web in its transverse direction or transversely with respect to its transport direction. Said severing apparatus is expediently actuatable so as to at least regionally sever the first material web. A severing of the first material web in its transverse direction is to be understood in particular to mean a severing of the first material web perpendicularly and/or obliquely with respect to a longitudinal direction or transport direction of the first material web.

The severing apparatus is in particular designed so as to completely or initially only partially sever the first material web when actuated. In the case of complete severing, two web sections are in effect formed from the first material web. In the case of initially only regional severing of the first material web, the first material web initially remains coherent, which can be achieved for example by means of a corresponding weakening of the first material web in terms of its thickness, by means of a perforation, or the like.

The severing apparatus is designed for example as a blade apparatus, punching apparatus, or the like. It is for example of translational and/or rotational type, and comprises at least one severing element. The blade apparatus comprises for example at least one displaceable severing blade and/or static severing blade.

The severing is expediently performed automatically or by means of at least one actuated severing element.

In one preferred embodiment, the severing apparatus is designed as a severing auxiliary device for assisting a severing of the first material web. The severing apparatus then comprises for example only at least one severing element guide. The severing is then performed for example manually or by hand, such as by means of a cutter blade.

It is advantageous if the severing apparatus is positioned downstream of a dispensing apparatus for dispensing the first material web.

It is advantageous if the corrugating apparatus comprises at least two rotatably mounted and/or rotationally driveable corrugating rolls which delimit or form a corrugating gap for the leadthrough and corrugating of the first material web.

The glue-applying apparatus expediently has a glue container for accommodating glue and a glue-applying roll for transferring the glue to the tips of the corrugation of the corrugated web. It is advantageous if the glue-applying apparatus furthermore has a glue-dosing roll for the dosed transfer of the glue to the corrugated web.

The pressing apparatus comprises, for example, at least one pressing roll or a pressing belt module.

The first material web is expediently endless and of single-ply configuration. It is transported by the arrangement for producing a corrugated cardboard web laminated on one side, during the operation thereof. The first material web is preferably a smooth web upstream of the corrugating apparatus.

The severing apparatus is preferably displaceable between an active severing position and an inactive parked position. In the active severing position, the severing apparatus is expediently at least partially in severing engagement with the first material web to be severed. It is advantageous if the severing apparatus, in its inactive parked position, is arranged so as to be out of engagement with the first material web or so as to be spaced apart therefrom.

The at least two severing elements of the severing device, which are displaceable in the transverse direction of the first material web and serve for generating a wedge-shaped cut in the transported first material web, are expediently displaceable synchronously for the purposes of severing the first material web. Here, said severing elements are preferably guided. To form the wedge-shaped cut, it is preferable if a central section of the first material web remains coherent. The central section preferably has a breadth, in the transverse direction of the first material web, of between 100 mm and 400 mm, which is dependent on the width and/or tear resistance of said first material web. For this purpose, the severing elements are for example displaceable toward one another from mutually opposite longitudinal edges of the first material web, wherein the central section of the first material web remains in place. Alternatively, the severing elements are displaceable in the reverse direction, that is to say laterally outward away from one another, wherein the severing is commenced at a position offset with respect to the center of the first material web. The severing elements are expediently designed as cutting elements, perforating elements and/or punching elements. They are capable of at least regionally severing the first material web, as regards in particular the length of the severing and/or the depth of the severing.

The tear-off device of the severing apparatus for the controlled tearing-off of the first material web is extremely practical. The tear-off device is expediently assigned a static cutting device. The first material web preferably remains coherent up until the controlled tearing-off process. The first material web is preferably already regionally severed in its transverse direction upstream of the tear-off device. It is advantageous if the tear-off device is positioned downstream of a severing device for regionally severing the first material web in its transverse direction. In particular, the tearing-off thus takes place after the first material web has already been regionally severed in its transverse direction.

The actuatable holding apparatus, which is positioned downstream of the severing apparatus and which serves for holding a trailing web section, generated by means of the severing apparatus, of the first material web, is preferably displaceable between an inactive and an active position or holding position. The holding of the trailing web section of the first material web is preferably performed by means of at least one holding element of the holding apparatus. It is performed for example by virtue of the first material web being immobilized with clamping action. Other configurations are alternatively possible.

The holding apparatus, in its active position, permits particularly good handling, or extremely secure hold, of the trailing web section, generated by means of the severing apparatus, of the first material web. By means of the holding apparatus, the trailing web section of the first material web can be fixed or spatially immobilized.

This simplifies the further processing or handling of the trailing web section of the first material web. The holding apparatus is preferably arranged adjacent to the corrugating apparatus and/or severing apparatus. The holding apparatus is preferably arranged between the corrugating apparatus and the severing apparatus.

According to one preferred embodiment, the holding apparatus, which comprises a first holding device and a second holding device, arranged spaced apart from the first holding device, for holding the trailing web section, generated by means of the severing apparatus, of the first material web, in an active position, forming the severing apparatus, is preferably capable of holding the first material web such that the first material web tears in its transverse direction, in particular during the start-up of the plant for producing corrugated cardboard and/or when a corresponding tensile force is exerted on said first material web. In particular, here, the holding moment exerted on the first material web by the holding apparatus is greater, preferably significantly greater, than a start-up moment or tensile moment exerted on the first material web during the start-up thereof, or during the start-up of the plant for producing corrugated cardboard.

The embodiment configured such that a corrugating apparatus changeover apparatus for changing over the corrugating apparatus is provided, wherein preferably, the corrugating apparatus changeover apparatus comprises at least one hitherto inactive corrugating apparatus for replacing the hitherto active corrugating apparatus, permits a particularly simple and quick replacement of the hitherto active corrugating apparatus with a hitherto inactive corrugating apparatus. It is thus for example easily possible for the fluting or corrugation of the corrugated web to be changed, for example owing to an order change.

In particular, here, the at least one hitherto inactive corrugating apparatus is displaceable, in particular pivotable, from an inactive parked position into an active corrugating position.

It is advantageous if the first material web is led through the active corrugating apparatus for the purposes of generating the corrugated web. The first material web is expediently led past the inactive corrugating apparatus.

According to a preferred embodiment, during this displacement of the hitherto inactive corrugating apparatus and/or hitherto active corrugating apparatus, it is for example the case that severing of the first material web is performed, preferably by means of a static cutting device of the severing apparatus. The first material web is then preferably led correspondingly via the cutting device, and severed owing to the kinematic arrangement present.

It is expedient if the transport apparatus, which is positioned downstream of the severing apparatus and which serves for transporting a trailing web section, generated by means of the severing apparatus, of the first material web to the corrugating apparatus, wherein preferably, the transport apparatus comprises a first transport device and a second transport device, arranged spaced apart from the first transport device, for transporting the trailing web section, generated by means of the severing apparatus, of the first material web to the corrugating apparatus, comprises at least one driveable, in particular rotationally driveable, transport element, such as a transport belt, a transport roll, a transport roller or the like, for transporting the trailing web section, generated by means of the severing apparatus, of the first material web into the active corrugating apparatus. The arrangement for producing a corrugated cardboard web laminated on one side can thus in particular be particularly reliably and easily set in operation again after a changeover of the corrugating apparatus. The first material web can thus be conveyed particularly reliably and easily into the active corrugating apparatus again. The transport of the trailing web section of the first material web is expediently realized in automatic or automated fashion.

It is advantageous if, in the case of an active transport apparatus for transporting the downstream web section of the first material web, the holding apparatus also has an active guiding action in order, during said transport, to hold and/or guide and convey said web section.

The transport apparatus is preferably arranged adjacent to the corrugating apparatus and/or severing apparatus. The transport apparatus is preferably arranged between the corrugating apparatus and the severing apparatus.

It is expedient if, according to one preferred embodiment, the holding apparatus and the transport apparatus together form a holding-transport apparatus for holding and/or transporting the trailing web section, generated by means of the severing apparatus, of the first material web.

It is advantageous if, for this purpose, the first holding device and the first transport device form a first holding-transport unit. It is expediently additionally the case that the second holding device and the second transport device form a second holding-transport unit.

It is advantageous if the holding-transport units are arranged spaced apart from one another. The holding-transport units are preferably actuatable independently of one another. It is expedient if the second holding-transport unit is arranged downstream of the first holding-transport unit in relation to the transport direction of the first material web.

It is expedient if the severing apparatus is a constituent part of the arrangement for producing a corrugated cardboard web laminated on one side.

The plant expediently has a housing in which the corrugating apparatus, the glue-applying apparatus, the pressing apparatus and the severing apparatus are accommodated. The housing is formed for example by a single housing or one coherent housing. The holding apparatus and/or transport apparatus are expediently also accommodated therein.

It is expedient if the plant comprises a dispensing apparatus, positioned upstream of the arrangement for producing a corrugated cardboard web laminated on one side, for dispensing the first material web, wherein the severing apparatus is arranged between the dispensing apparatus and the corrugating apparatus.

The severing apparatus or the at least one severing element is alternatively formed for example by a cutter blade, which is utilized in a free or unguided configuration for at least originally severing the first material web in its transverse direction. In particular, the cutter blade is then actuated, or used with cutting/severing action, by a machine operator. It is advantageous if a wedge-shaped cut is generated.

It is expedient if the holding apparatus holds the first material web during the at least regional severing thereof and thus simplifies the severing process. The holding apparatus expediently has a first holding device and a second holding device, arranged spaced apart from the first holding device, for holding the first material web. The severing is expediently performed adjacent to the second holding device.

It is expedient if the transport apparatus transports, in particular effects the incoming transport and/or outgoing transport of, the first material web or a web section thereof. The transport apparatus expediently has a first transport device and a second transport device, arranged spaced apart from the first transport device, for transporting the first material web or the web section thereof. The severing is expediently performed adjacent to the second transport device.

Combinations of the embodiments are possible.

The expressions "leading", "trailing", "upstream", "downstream", "positioned upstream", "positioned downstream" or the like used here relate generally to the associated material web, primarily to the endless first material web.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 8 to 11 is situated in its inactive position;

FIGS. 8 to 10 is situated in its inactive position;

FIGS. 13 to 15 is situated in its inactive position;

DESCRIPTION OF THE PREFERRED EMBODIMENTS

Figure 1:
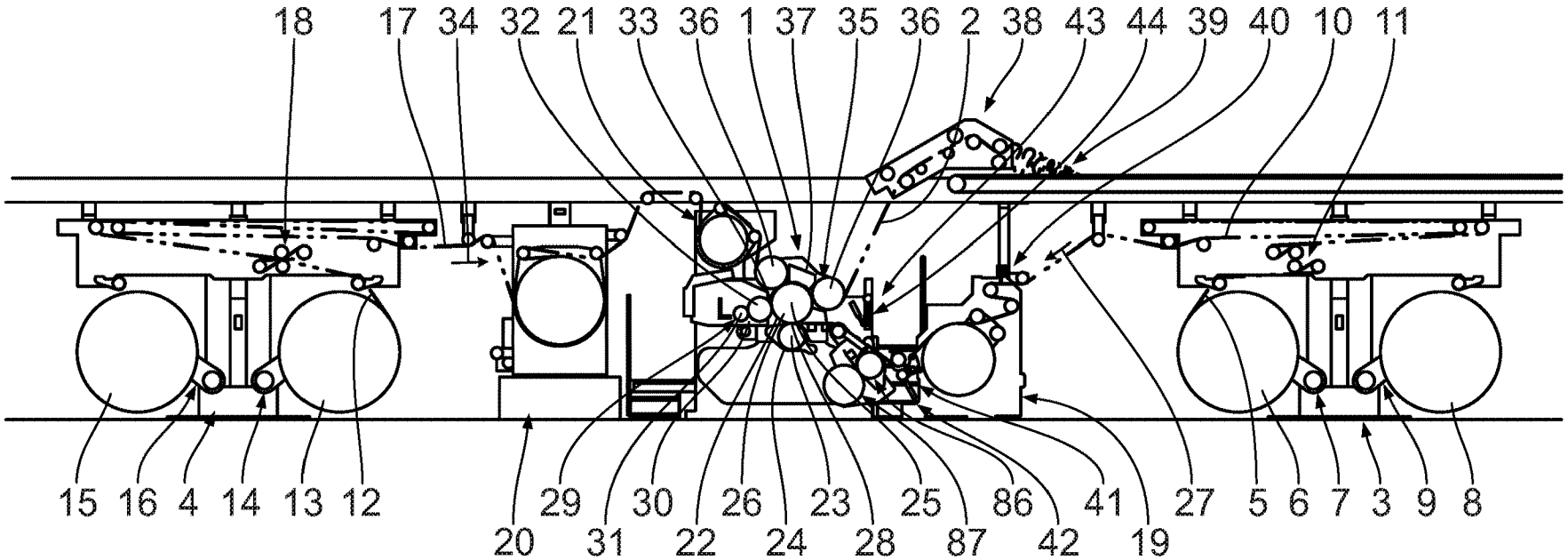
FIG. 1 is a simplified partial side view of a plant according to the invention for producing corrugated cardboard, having an arrangement for producing a corrugated cardboard web laminated on one side.

Referring firstly to FIG. 1, a plant, which is not fully illustrated in its entirety, for producing corrugated cardboard comprises at least one arrangement 1 for producing an endless corrugated cardboard web 2 laminated on one side.

Positioned upstream of the arrangement 1 for producing a corrugated cardboard web 2 laminated on one side are a first unrolling apparatus 3 and a second unrolling apparatus 4, which are designed as first and second splicing apparatuses 3, 4. The first splicing apparatus 3 comprises a first unrolling unit 7 for the unrolling of a finite first material web 5 from a first material web roller 6, and a second unrolling unit 9 for the unrolling of a finite second material web from a second material web roller 8. The finite first material web 5 and the finite second material web are connected to one another, in order to provide an endless first material web 10, by means of a connecting and cutting unit 11 of the first splicing apparatus 3.

The second splicing apparatus 4 is designed correspondingly to the first splicing apparatus 3. Said second splicing apparatus has a third unrolling unit 14 for the unrolling of a finite third material web 12 from a third material web roller 13, and a fourth unrolling unit 16 for the unrolling of a finite fourth material web from a fourth material web roller 15. The finite third material web 12 and the finite fourth material web are connected to one another, in order to provide an endless second material web 17, by means of a connecting and cutting unit 18 of the second splicing apparatus 4.

The endless first material web 10 is supplied via a first preheating apparatus 19 of the arrangement 1 for producing a corrugated cardboard web 2 laminated on one side. The endless second material web 17 is supplied via a second preheating apparatus 20 and a third preheating apparatus 21 of the arrangement 1 for producing a corrugated cardboard web 2 laminated on one side. The endless material webs 10, 17 are in this case supplied separately to the arrangement 1 for producing a corrugated cardboard web 2 laminated on one side.

The arrangement 1 for producing a corrugated cardboard web 2 laminated on one side comprises a first corrugating roll 24, which is mounted so as to be rotatable about a first axis of rotation 23, and a second corrugating roll 26, which is mounted so as to be rotatable about a second axis of rotation 25, for the purposes of generating an endless corrugated web 22, which has a corrugation, from the endless first material web 10. The axes of rotation 23, 25 run parallel to one another and perpendicular to a transport direction 27 of the endless first material web 5. The corrugating rolls 24, 26 together form a first or active corrugating apparatus. They delimit a corrugating gap 28 for the leadthrough and corrugating of the endless first material web 5.

For the connection of the endless corrugated web 22 to the endless second material web 17 to form the endless corrugated cardboard web 2 laminated on one side, the arrangement 1 for producing a corrugated cardboard web 2 laminated on one side has a glue-applying apparatus 29 downstream of the corrugating gap 28 with regard to the transport direction 27 of the endless first material web 10. The glue-applying apparatus 29 has a glue container 30, a glue-dosing roll 31 arranged in the glue container 30, and a glue-applying roll 32 arranged in the glue container 30. The glue-dosing roll 31 and the glue-applying roll 32 are mounted so as to be rotatable about corresponding axes of rotation, which run parallel to one another. The glue-dosing roll 31 is expediently designed as a glue squeeze roll.

For the leadthrough and gluing of the corrugated web 22, the glue-applying roll 32 forms, with the second corrugating roll 26, a gluing gap 33. Glue (not illustrated) situated in the glue container 30 is applied, by means of the glue-applying roll 32 that dips into it, to free tips of the corrugation of the transported corrugated web 22. The glue-dosing roll 31 is arranged substantially opposite the second corrugating roll 26 and adjacent to the glue-applying roll 32, and serves for forming a uniform glue layer on the glue-applying roll 32.

The corrugated web 22 provided with glue is subsequently joined together, in the arrangement 1 for producing a corrugated cardboard web 2 laminated on one side, with the endless second material web 17 transported in a transport direction 34, in order to realize the endless corrugated cardboard web 2 laminated on one side.

For the pressing of the endless second material web 17 against the corrugated web 22 provided with glue, which corrugated web lies in regions against the second corrugating roll 26, the arrangement 1 for producing a corrugated cardboard web 2 laminated on one side has a pressing belt module 35. The pressing belt module 35 is arranged downstream of the glue-applying apparatus 29 in relation to the transport of the corrugated web 22. Said pressing belt module is arranged above the second corrugating roll 26. The pressing belt module 35 has two rotatably mounted diverting rolls 36, and a pressing belt 37 led around the diverting rolls 36.

The second corrugating roll 26 engages in regions into a space present between the diverting rolls 36, whereby the pressing belt 37 is diverted. The pressing belt 37 presses against the endless second material web 17, which is thus in turn pressed against the corrugated web 22 provided with glue, which lies against the second corrugating roll 26.

The corrugated cardboard web 2 laminated on one side is then supplied by means of an upward transport apparatus 38 to a storage apparatus 39 for the purposes of temporary storage and buffering.

The corrugated cardboard web 2 laminated on one side is then, downstream of the storage apparatus 39, in a connecting apparatus (not illustrated), connected for example to a laminating web (not illustrated) in order to form a corrugated cardboard web laminated on two sides, or to a further corrugated cardboard web laminated on one side and to a laminating web in order to form a five-layer corrugated cardboard web (not illustrated).

Downstream of the connecting apparatus, there are for example arranged a longitudinal cutting/corrugating apparatus (not illustrated) for longitudinally cutting the corrugated cardboard web into partial corrugated cardboard webs, and a transverse cutting apparatus (not illustrated) for transversely cutting the partial corrugated cardboard webs into corrugated cardboard sheets, and a stacking apparatus (not illustrated) for stacking the corrugated cardboard sheets in stacks.

The arrangement 1 for producing a corrugated cardboard web 2 laminated on one side furthermore has, preferably at an input side, a severing apparatus 40. Alternatively, the severing apparatus 40 is arranged upstream of the arrangement 1 for producing a corrugated cardboard web 2 laminated on one side. Said severing apparatus is then arranged between the arrangement 1 for producing a corrugated cardboard web 2 laminated on one side and the first splicing apparatus 3. The severing apparatus 40 is assigned to the endless first material web 10 and is capable of severing the latter.

Furthermore, the arrangement 1 for producing a corrugated cardboard web 2 laminated on one side has a first holding device 41 and a first transport device 42, which are both arranged downstream of the severing apparatus 40 with regard to the endless first material web 10 and which are assigned to the endless first material web 10. The first holding device 41 and the first transport device 42 are combined to form a first holding-transport unit. They are arranged upstream of the corrugating apparatus.

Furthermore, the arrangement 1 for producing a corrugated cardboard web 2 laminated on one side has a second holding device 43 and a second transport device 44, which are both arranged downstream of the first holding-transport unit with regard to the endless first material web 10 and which are assigned to the endless first material web 10. The second holding device 43 and the second transport device 44 are combined to form a second holding-transport unit. They are arranged upstream of the corrugating apparatus.

The first holding-transport unit and the second holding-transport unit are capable of holding the endless first material web 10 and/or transporting or conveying it in the transport direction 27. In the holding situation, the endless first material web 10 is substantially regionally spatially immobilized or stopped, whereas, in the transporting situation, said endless first material web is transported so as to be guided in the transport direction 27 with a transport speed.

Figure 2:
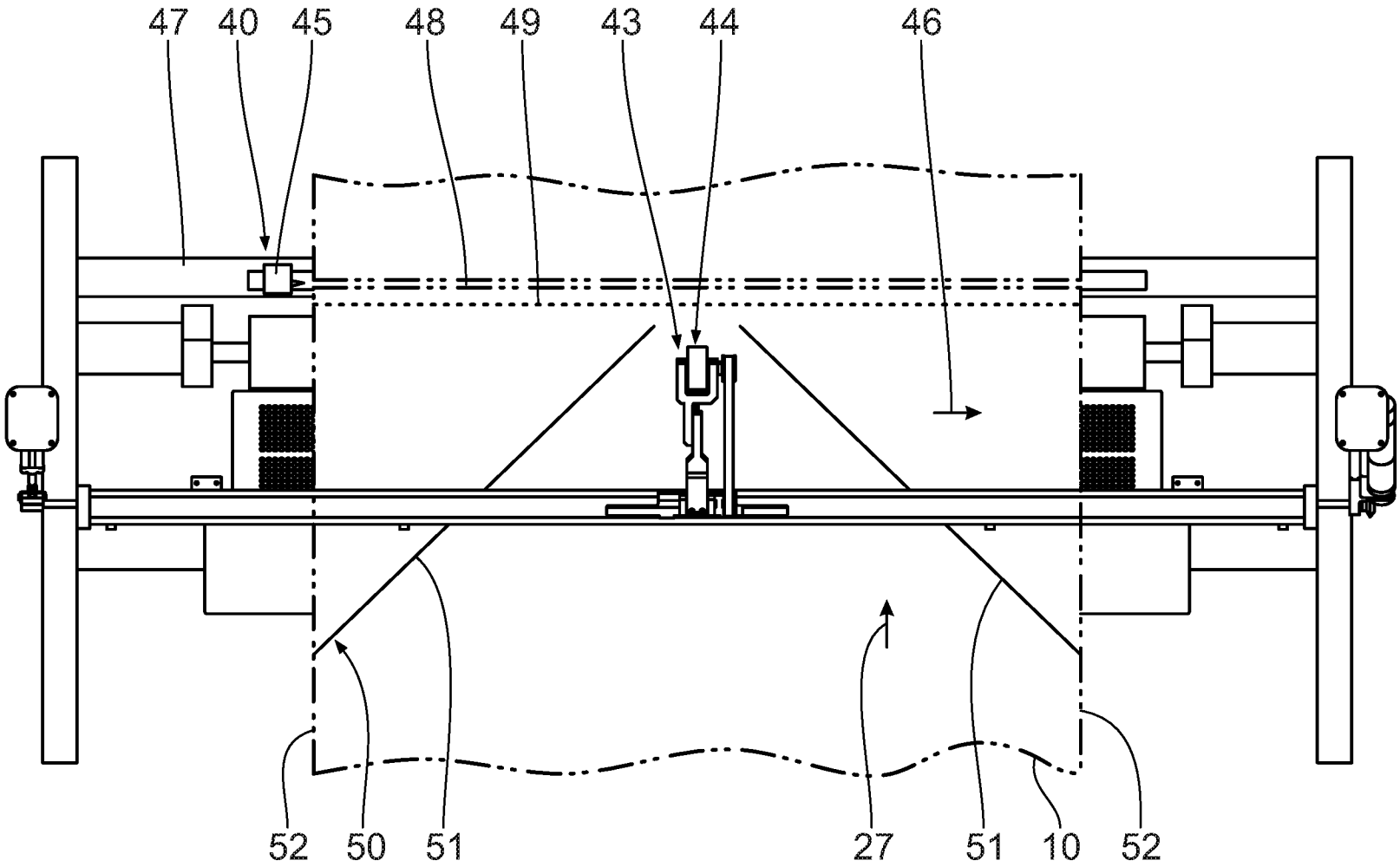
FIG. 2 is a view illustrating different possibilities for the severing of the first material web by means of a severing apparatus of the plant shown in FIG. 1.
Figure 3:
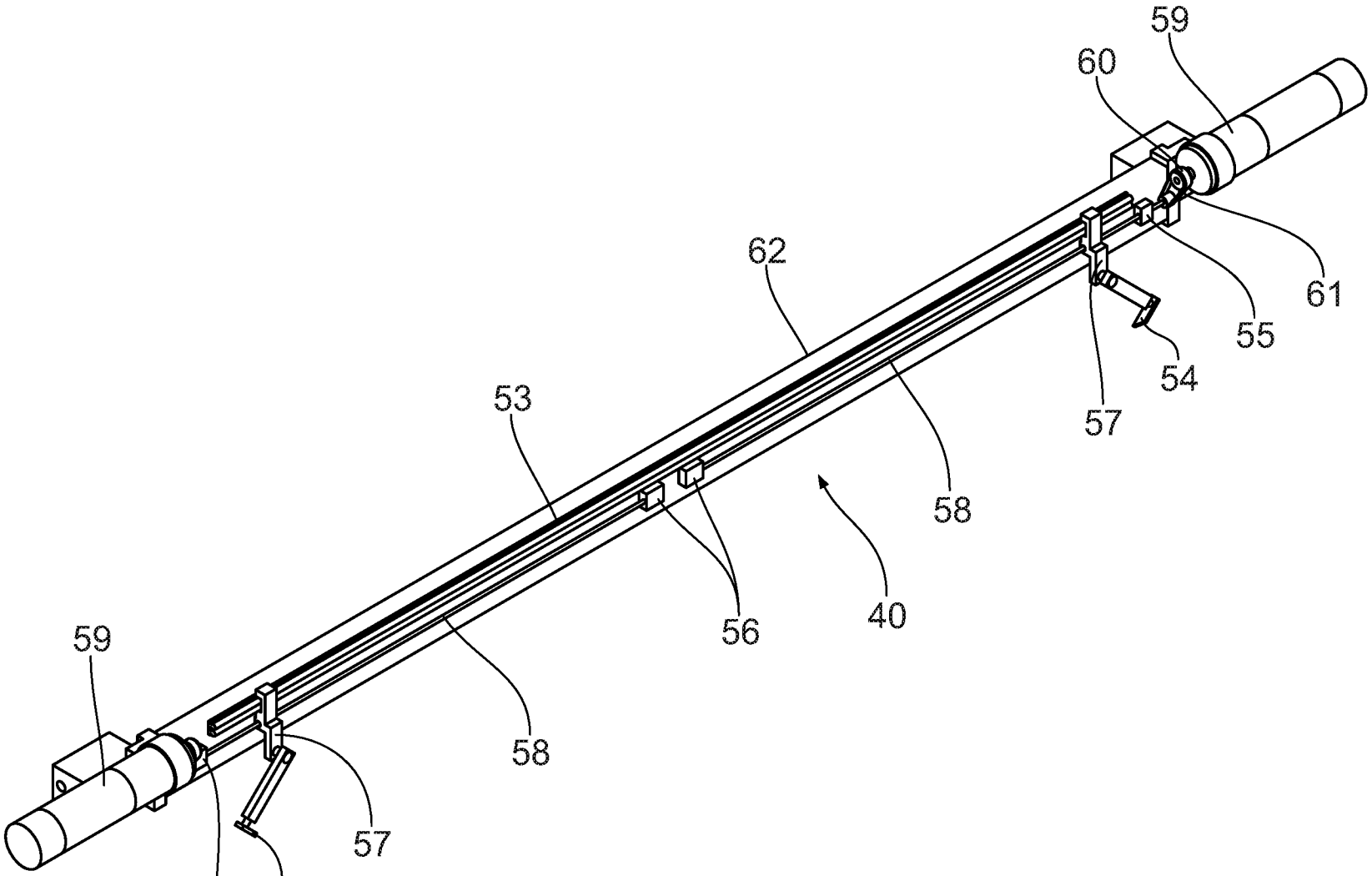
FIG. 3 is a perspective view of a severing apparatus which can for example be used in the plant shown in FIG. 1.
Figure 5:
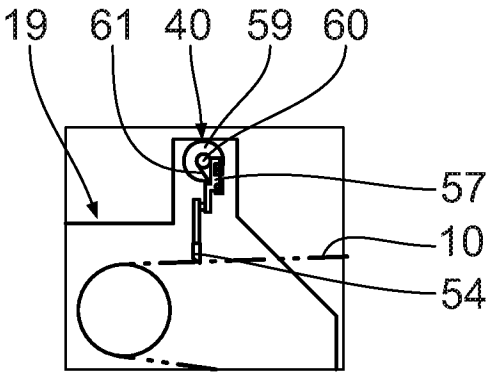
FIG. 5 is an enlarged view which shows the severing apparatus shown in FIG. 4 in its active severing position.
Figure 4:
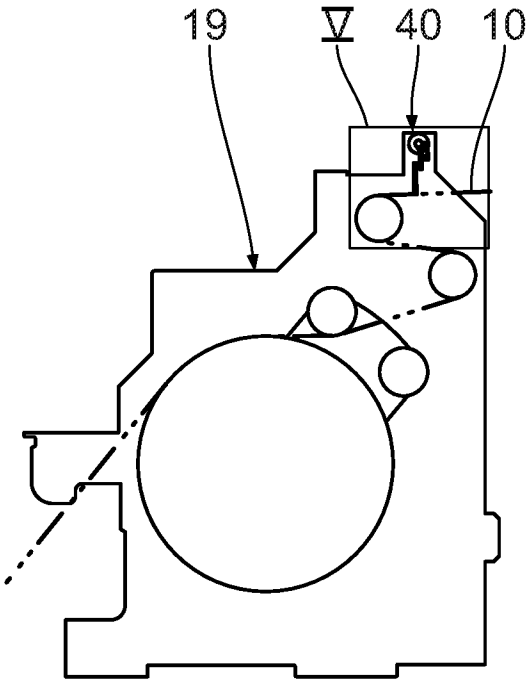
FIG. 4 is a side view which also shows the severing apparatus shown in FIG. 3 in its active severing position.
Figure 7:
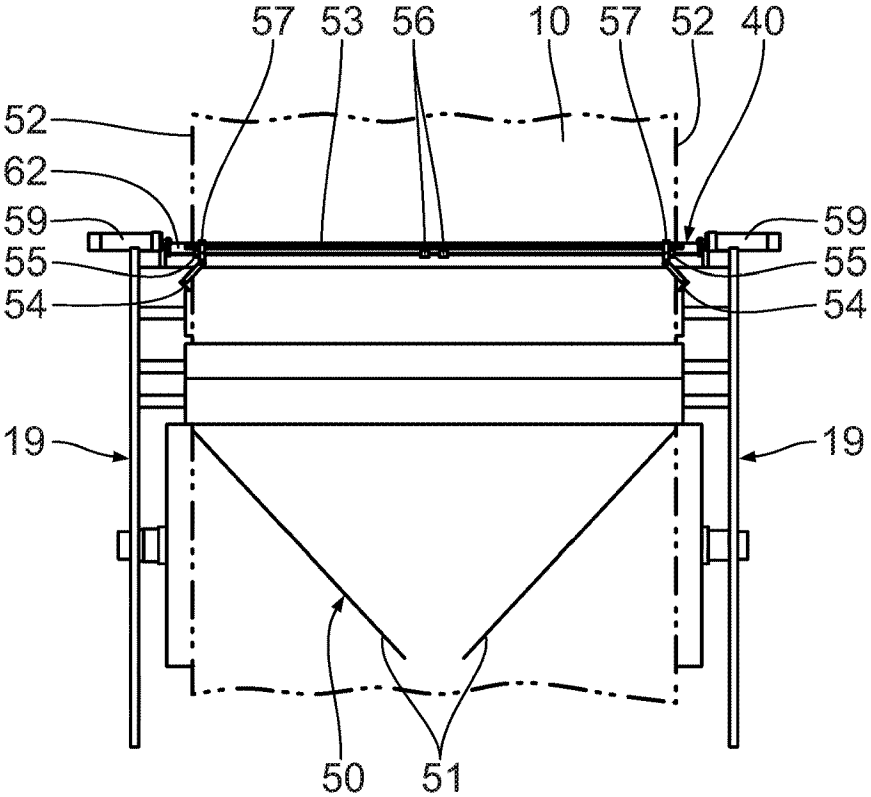
FIG. 7 is a view showing the first material web prepared by means of the severing apparatus as per FIGS. 3 to 6 for the severing by means of a wedge-shaped cut.
Figure 6:
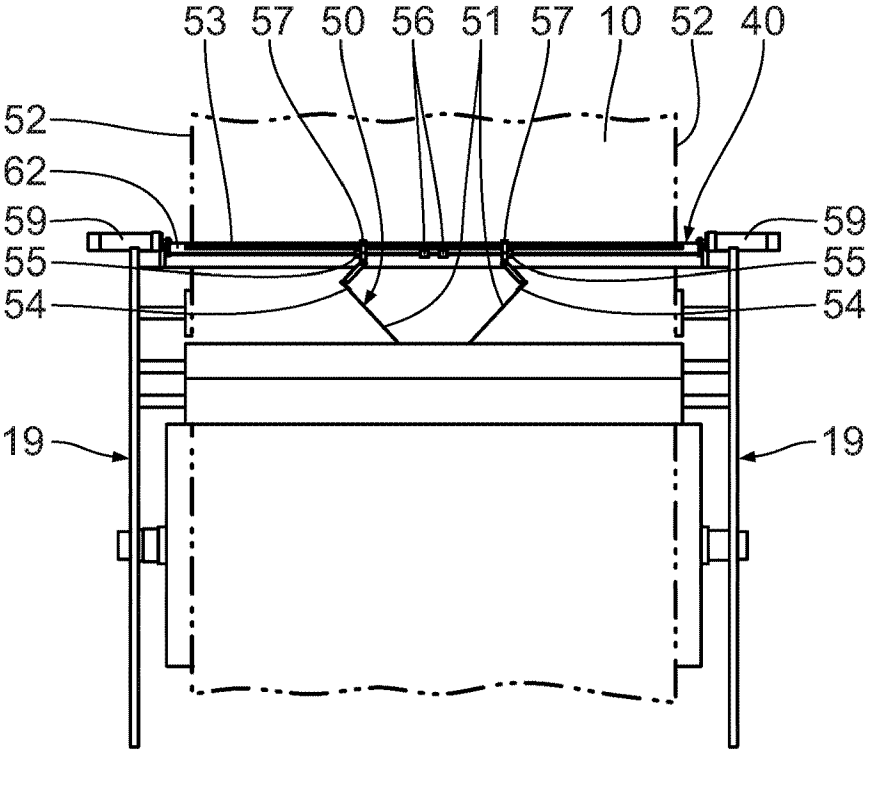
FIG. 6 is a view of the severing apparatus shown in FIGS. 3 to 5 at the start of a severing of the first material web by means of a wedge-shaped cut.
Figure 9:
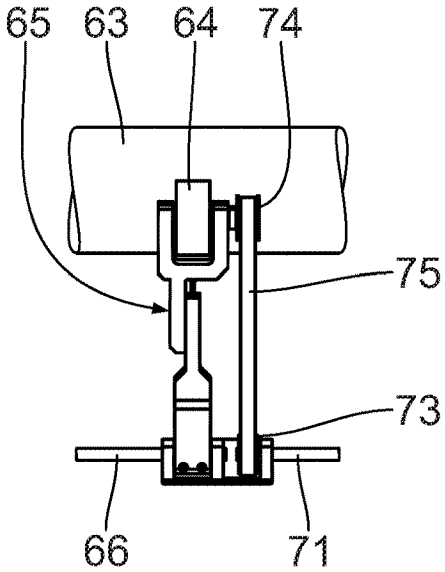
FIG. 9 is an enlarged partial view of the unit illustrated in FIG. 8.
Figure 10:
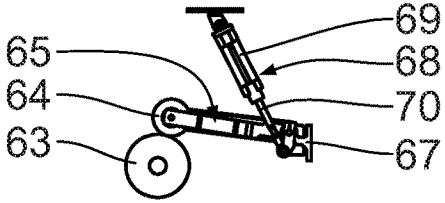
FIG. 10 is a further view of the unit illustrated in FIGS. 8 and 9, which is situated in its active position.
Figure 8:
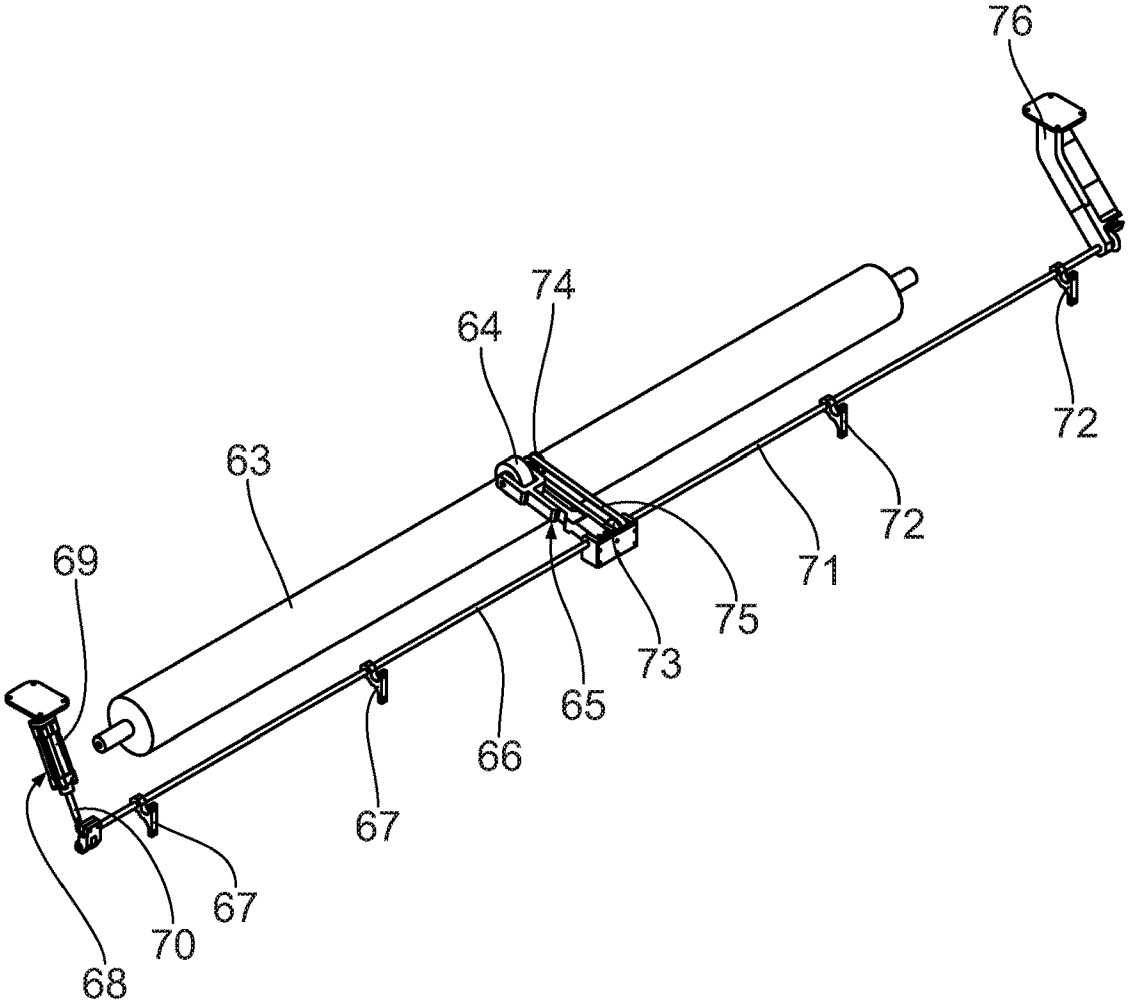
FIG. 8 is a view of a unit composed of a holding device and a transport device of the plant shown in FIG. 1.
Figure 12:
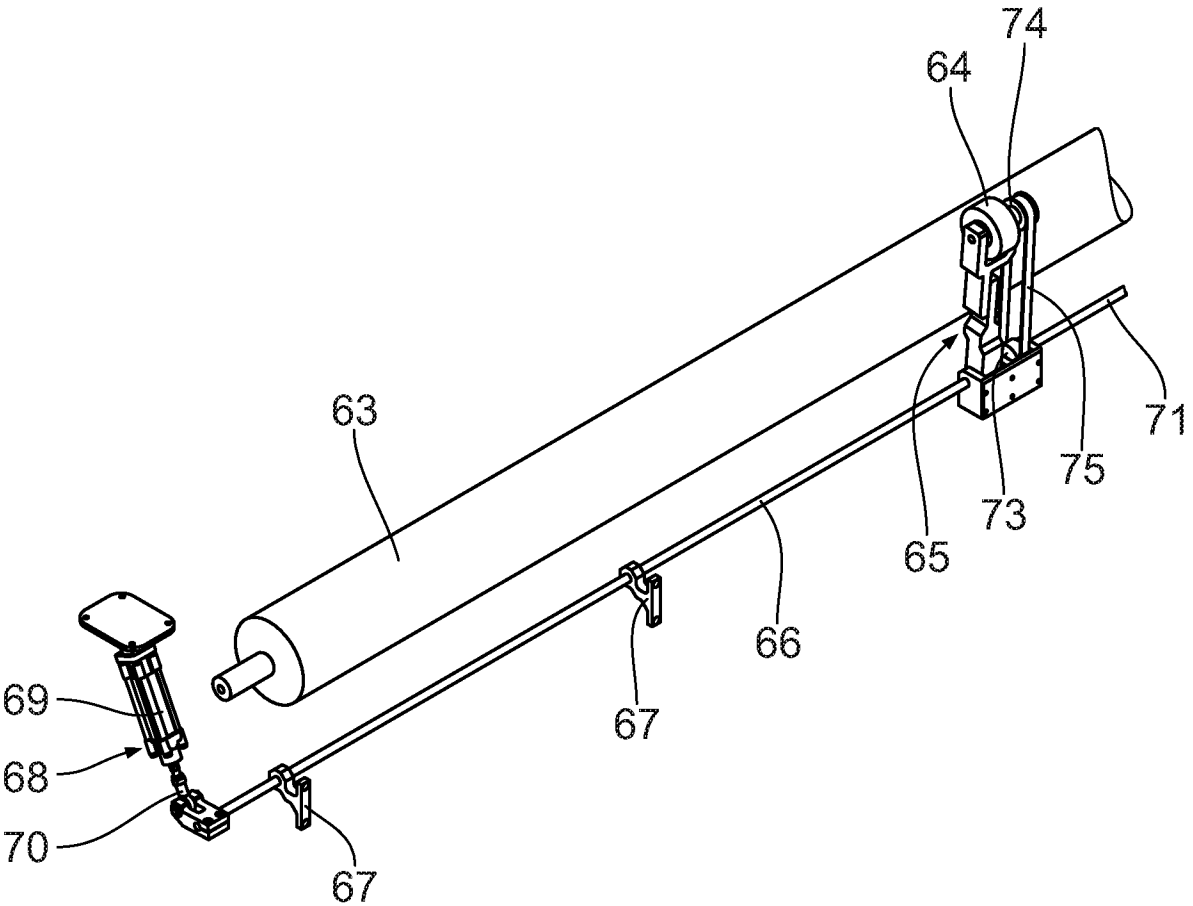
FIG. 12 is a perspective view corresponding to FIG. 8, in which the unit as per
Figure 11:
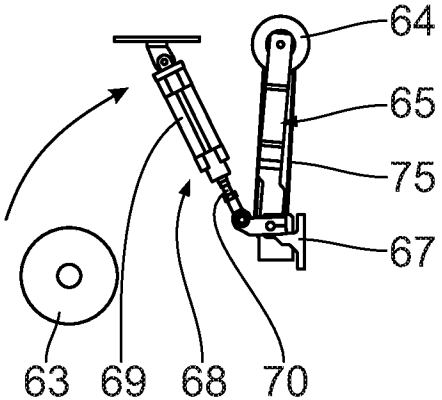
FIG. 11 is a view corresponding to FIG. 10, wherein there, the unit as per
Figure 13:
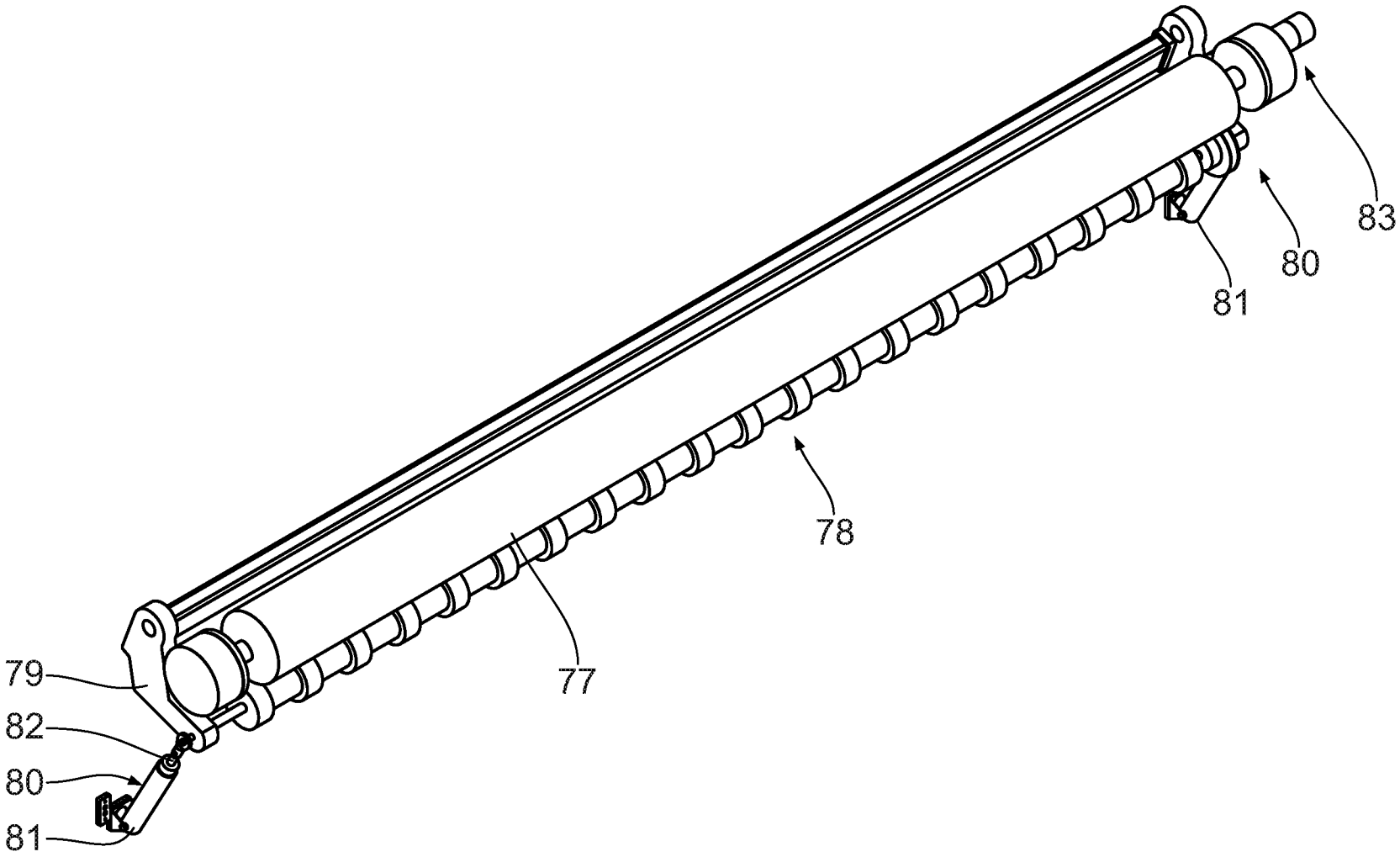
FIG. 13 is a perspective view of a further unit composed of a holding device and of a transport device of the plant illustrated in FIG. 1.
Figure 15:
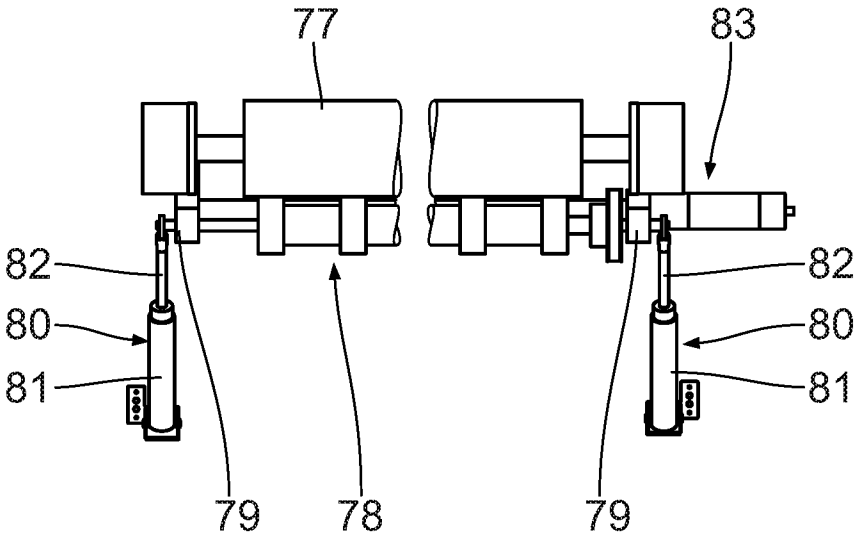
FIG. 15 is a further view of the further unit illustrated in FIGS. 13 and 14.

As shown in FIG. 2, the severing apparatus 40 may be designed in different ways. For example, the severing apparatus 40 comprises a severing element 45 which is movable along a guide 47 which extends over the entire endless first material web 10 in a transverse direction 46, running perpendicular to the transport direction 27, of the endless first material web 10. The severing element 45 is thus movable in the transverse direction 46 of the endless first material web 10. Said severing element is displaceable between a severing position and an inactive parked position.

The severing element 45 is designed for example as a severing blade and is thus capable of generating a transversely running, continuous severing cut 48 in the endless first material web 10.

Alternatively, the severing element 45 is designed for example as a perforator and is thus capable of generating a perforation 49 in the endless first material web 10 in its transverse direction 46.

Alternatively, the severing apparatus 40 is capable of generating a wedge-shaped cut 50 in the endless first material web 10. The wedge-shaped cut 50 is formed by two oblique cuts 51, which converge on one another obliquely from a respective longitudinal edge 52 of the endless first material web 10 in the transport direction 27, but end with a spacing to one another.

Referring to FIGS. 3 to 7, the severing apparatus 40 for generating the wedge-shaped cut 50 will be described in more detail. The severing apparatus 40 shown in FIGS. 3 to 7 has a guide 53 which extends over the entire width of the endless first material web 10 in the transverse direction 46 of the endless first material web 10.

Two severing blades 54 are displaceable along the guide 53. Each severing blade 54 is in this case displaceable in the transverse direction 46 of the endless first material web 10 between an outer stop 55 and an inner stop 56. The outer stops 55 are arranged adjacent to the longitudinal edges 52 of the endless first material web 10, whereas the inner stops 56 are arranged spaced apart from one another and are arranged adjacent to a central region of the endless first material web 10. Thus, for each severing blade 54, a movement travel specific thereto is determined by the stops 55, 56. The movement travels are aligned with one another and end with a spacing to one another. The stops 55, 56 are expediently adjustable along the guide 53.

The severing blades 54 are expediently displaceable between a severing position and a parked position.

Each severing blade 54 is arranged on a carriage 57, which is guided along the guide 53.

Each carriage 57 is extended through for example by a threaded spindle 58, which has an external thread and which is mounted rotatably in an inner and outer stop 55, 56. For this purpose, each carriage 57 has a complementary internal thread, and forms, together with the corresponding threaded spindle 58, a worm drive.

Each threaded spindle 58 can be driven in rotation about its longitudinal central axis. For this purpose, each threaded spindle 58 is assigned an actuating motor 59, the drive shaft 60 of which is connected in terms of drive by means of a respective drive belt 61 to the respective threaded spindle 58.

The guide 53, the stops 55, 56 and the actuating motor 59 are arranged together on a transverse member 62.

Actuation of the actuating motors 59 causes their drive shafts 60 to be set in rotation, whereby, via the drive belts 61, the threaded spindles 58 are also set in rotation. By means of the respective worm drive between the carriage 57 and the associated threaded spindle 58, the rotational movement of the threaded spindles 58 is converted into a translational movement of the carriages 57 and thus of the severing blades 54. The actuating motors 59 are, as the endless first material web 10 is transported, actuated simultaneously so as to generate the wedge-shaped cut 50.

The carriages 57 or the severing blades 54 are, for this purpose, situated initially adjacent to the inner stops 56. In their severing position, they engage into the transported endless first material web 10 with cutting action, or penetrate through the endless first material web 10 with cutting action. The carriages 57 or the severing blades 54 are then, by corresponding actuation of the actuating motors 59, moved to the outer stops 55, whereby each severing blade 54 generates an oblique cut 51 proceeding from a central region of the endless first material web 10 to the adjacent longitudinal edge 52. Owing to the simultaneous transport of the endless first material web 10, the transverse displacement of the severing blades 54 gives rise to the oblique cuts 51, which together form the wedge-shaped cut 50. The carriages 57 or severing blades 54 may also be driven or displaced in some other way.

The second holding-transport unit will be described below in particular with reference to FIGS. 8 to 12. Said unit comprises a rotatably mounted guide roll 63 and a holding running roller 64, between which the endless first material web 10 runs upon the restart of the plant for producing the corrugated cardboard or of the arrangement 1 for producing an endless corrugated cardboard web 2 laminated on one side. The second holding-transport unit is otherwise inactive.

The guide roll 63 extends over the entire width of the endless first material web 10. Said guide roll is mounted so as to be rotatable.

The holding running roller 64 is mounted rotatably, or so as to be rotationally driveable, in a support body 65. Said holding running roller 64 extends only over a part of the width of the endless first material web 10. The support body 65 is seated rotationally conjointly on a pivot shaft 66, which is mounted pivotably in bearing bodies 67 and which runs parallel to the guide roll 63. The support body 65 is connected to an adjusting cylinder unit 68. The adjusting cylinder unit 68 has a static housing 69 and has a piston rod 70 which is displaceable along the housing 69, which piston rod is thus capable of pivoting the pivot shaft 66 and thus also the support body 65 with the holding running roller 64. The holding running roller 64 is thus displaceable between an active position shown in FIG. 10 and an inactive position shown in FIG. 11.

Also connected to the support body 65 is a drive shaft 71, which is preferably aligned with the pivot shaft 66. The drive shaft 71 is mounted rotatably, or so as to be rotationally driveable, in bearing bodies 72.

A drive wheel 73 is arranged rotationally conjointly on the drive shaft 71, adjacent to the support body 65. Furthermore, the holding running roller 64 is connected rotationally conjointly to a second drive wheel 74. An endless drive belt 75 is guided around the two drive wheels 73, 74.

A drive motor 76 is connected rotationally conjointly to the drive shaft 71, such that said drive motor is capable of setting the drive shaft 71 in rotation.

A rotational movement of the drive shaft 71 causes the first drive wheel 73 to be driven in rotation and thus also causes the drive belt 75 to be driven, whereby the second drive wheel 74 and thus also the holding running roller 64 coupled thereto are set in rotation.

If the holding running roller 64 lies against the endless first material web 10 and is stationary, then the endless first material web 10 is held with an in particular predefined holding moment, or is spatially immobilized or stopped, between the holding running roller 64 and the guide roll 63. There, a holding gap or clamping gap is delimited between the holding running roller 64 and the guide roll 63. Here, if the holding running roller 64 is driven in rotation, the endless first material web 10 is transported or moved so as to be guided in its transport direction 27. When the corrugated web 22 is gripped by the active corrugating apparatus, a freewheel in the holding running roller 64 engages. The freewheel is then active. When the holding running roller 64 is lifted off from the endless first material web 10 and is thus situated in its inactive position, the endless first material web 10 is neither held by said holding running roller nor transported by said holding running roller in the transport direction 27.

The holding running roller 64, the drive wheels 73, 74, the drive belt 75, the drive shaft 71 and the drive motor 76 are constituent parts of the second transport device. The holding running roller 64 is also a constituent part of the second holding device.

The first holding-transport unit will be described below with reference to FIGS. 13 to 17. Said unit comprises a guide roll 77, which extends in the transverse direction 46 of the endless first material web 10 and which runs over the entire width of the endless first material web 10. The guide roll 77 is rotatably mounted.

Running parallel to the guide roll 77, there is a clamping transport roller arrangement 78, which again extends over the entire width of the endless first material web 10 and which expediently bears multiple ring-shaped projections or running rollers.

The clamping transport roller arrangement 78 is mounted, such that it can be driven in rotation, in a bearing frame 79. The bearing frame 79 is mounted so as to be pivotable about a pivot axis. Two pivot cylinder units 80 serve for the pivoting of the bearing frame 79 about the pivot axis. Each pivot cylinder unit 80 has a static housing 81 and a piston rod 82 guided in axially displaceable fashion in the respective housing 81. By displacement of the piston rods 82 relative to the associated housing 81, the bearing frame 79 and thus also the clamping transport roller arrangement 78 are pivotable.

The clamping transport roller arrangement 78 can be driven in rotation. For this purpose, a rotary drive 83 is provided, the drive shaft 84 of which is connected in terms of drive to the clamping transport roller arrangement 78 by means of a drive belt 85.

The rotary drive 83 and the drive belt 85 and the clamping transport roller arrangement 78 are constituent parts of the first transport device. The clamping transport roller arrangement 78 is also a constituent part of the first holding device.

Figure 14:
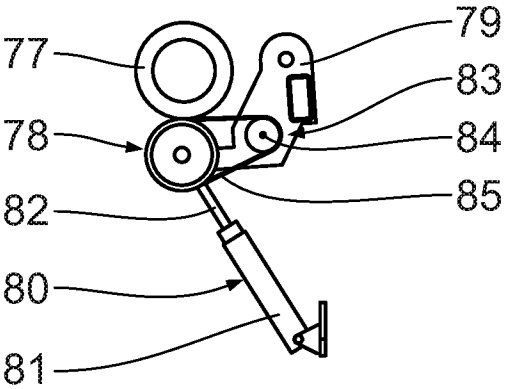
FIG. 14 is a side view of the further unit shown in FIG. 13, wherein the further unit is situated in its active position.
Figure 17:
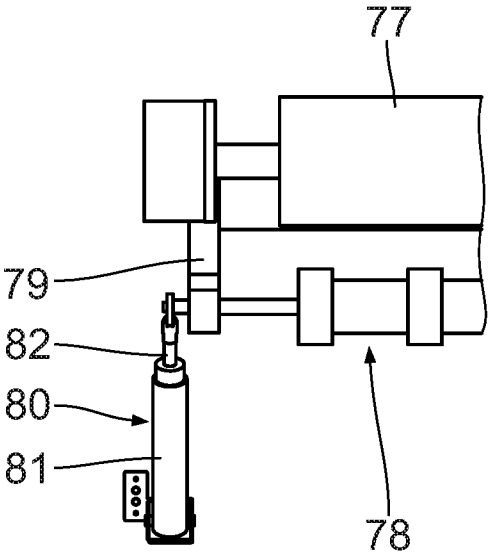
FIG. 17 is a further view of the further unit shown in FIGS. 13 to 16.

In its active position shown in FIG. 14, the clamping transport roller arrangement 78 is arranged adjacent to the guide roll 77. The clamping transport roller arrangement 78 and the guide roll 77 then lie against opposite sides of the endless first material web 10. If the clamping transport roller arrangement 78 lies against the endless first material web 10 and clamps the latter relative to the guide roll 77, then the finite first material web 10 is spatially immobilized or stopped there. Here, the clamping transport roller arrangement 78 is not driven, or is at a standstill.

By contrast, if the clamping transport roller arrangement 78 is still set in rotation, the endless first material web 10 is thus transported in the transport direction 27.

When the corrugated web 22 is gripped by the active corrugating apparatus, a freewheel in the clamping transport roller arrangement 78 engages. The freewheel is then active.

Figure 16:
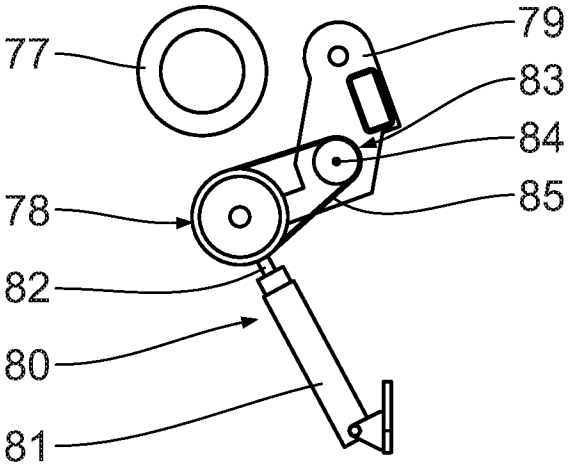
FIG. 16 is a view corresponding to FIG. 14, wherein the further unit as per
Figure 19:
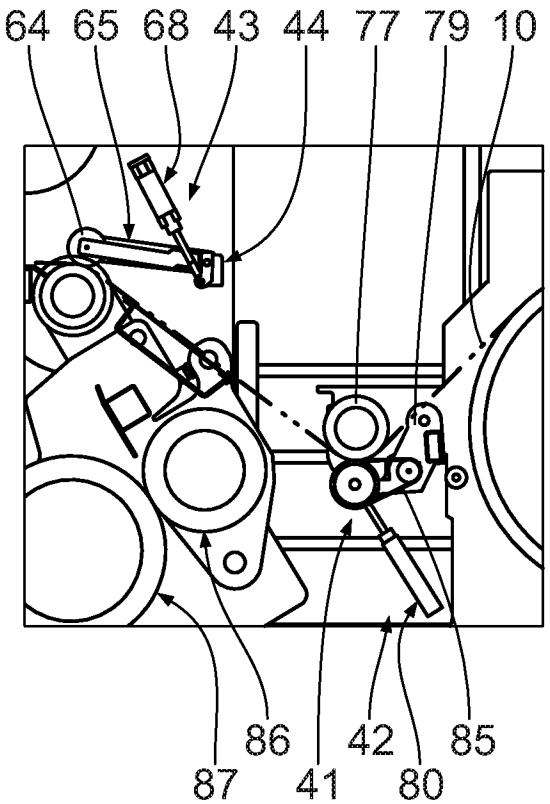
FIG. 19 is a view of a partial detail from FIG. 18, wherein the units shown in FIGS. 8 to 12 and 13 to 17 are now situated in their respective (active) holding position.

In its inactive position shown in FIG. 16, the clamping transport roller arrangement 78 is lifted off from the first guide roll 77 or from the endless first material web 10. Said clamping transport roller arrangement then has no influence.

The arrangement 1 for producing a corrugated cardboard web laminated on one side furthermore has a corrugating apparatus changeover apparatus 86, which stores a hitherto inactive second corrugating apparatus 87. The corrugating apparatus changeover apparatus 86 is arranged substantially between the severing apparatus 40 and the glue-applying apparatus 29. Said corrugating apparatus changeover apparatus is capable of replacing the hitherto active corrugating apparatus with the hitherto inactive corrugating apparatus 87. The hitherto inactive corrugating apparatus 87 also has two corrugating rolls for corrugating the endless first material web 10. By contrast to the corrugating apparatus that had hitherto been in use, the hitherto inactive corrugating apparatus 87 differs in terms of its corrugation from the hitherto used corrugation.

The operation of the corrugated cardboard plant will be described below with reference to FIGS. 18 to 26.

Figure 18:
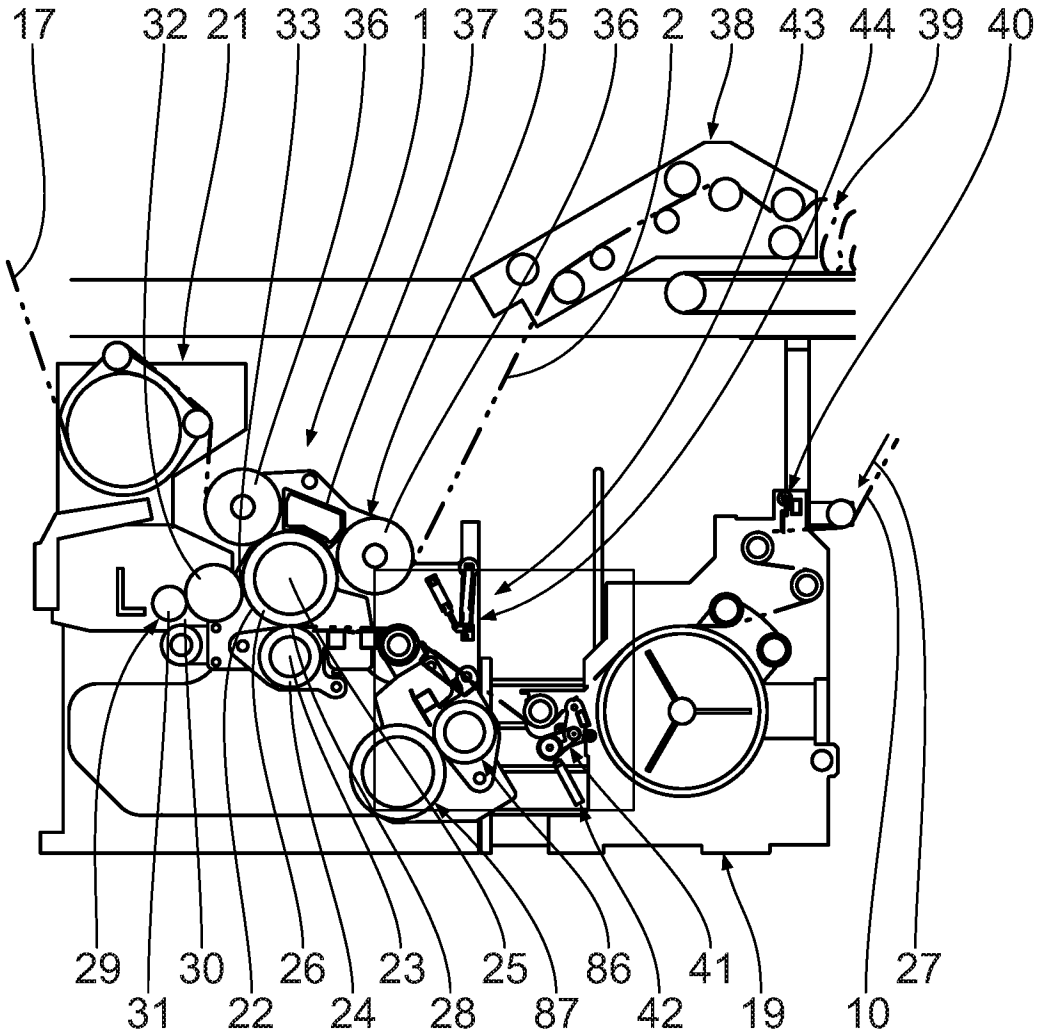
FIG. 18 is a partial view of the plant shown in FIG. 1, which illustrates the production of a corrugated cardboard web laminated on one side.

As shown in FIG. 18, the endless first material web 10 runs past the severing apparatus 40. Here, the severing apparatus 40 is inactive and does not act on the endless first material web 10. Furthermore, the endless first material web 10 passes the first holding-transport unit and the second holding-transport unit, which are both inactive and do not act on the endless first material web 10. The second corrugating apparatus 87 is situated in its inactive parked position. The endless first material web 10 is corrugated by the first corrugating apparatus and is glued by the glue-applying apparatus 29. The endless second material web 17 is connected to the endless first material web 10 so as to form the corrugated cardboard web 2 laminated on one side.

When, in particular, a production order has come to an end and a new production order with different fluting or corrugated web corrugation is present, the hitherto active corrugating apparatus is exchanged for the hitherto inactive second corrugating apparatus 87.

Figure 20:
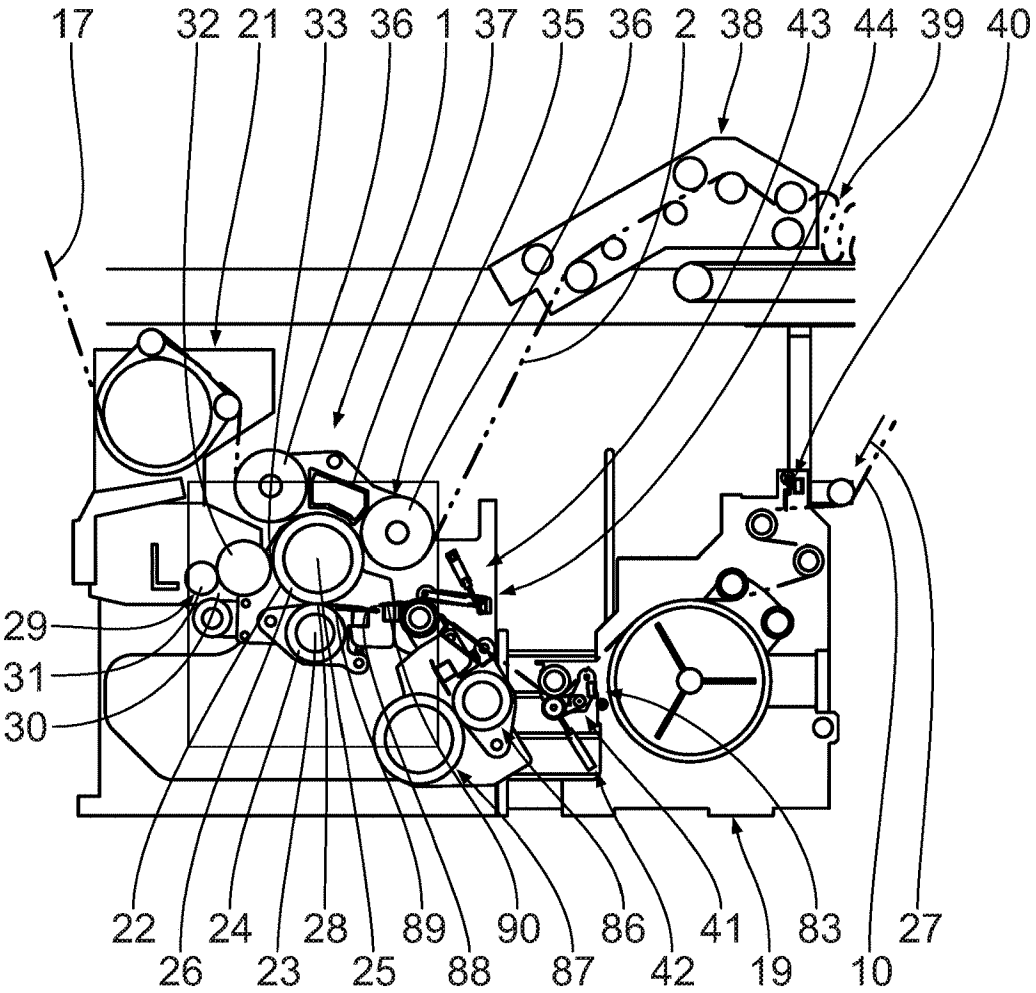
FIG. 20 is a partial view corresponding to FIG. 18, wherein the first material web has been severed by tearing.

For this purpose, the first holding-transport unit and the second holding-transport unit are actuated. They are pivoted out of their respective inactive position. Here, the clamping transport roller arrangement 78 and the holding running roller 64 press the endless first material web 10 with clamping action against the associated guide roll 63 or 77 respectively, whereby the endless first material web 10 is spatially immobilized or stopped there. They are situated in their respective holding positions. As shown in FIG. 20, an undefined transverse severing of the endless first material web 10 then occurs as a result of a crack 88 that has formed. The holding-transport units form a severing apparatus.

A leading web section 89, formed as a result of the crack 88, of the endless first material web 10 is conveyed out of the arrangement 1 for producing a corrugated cardboard web 2 laminated on one side while a trailing web section 90 of the endless first material web 10 is spatially immobilized in the arrangement 1 for producing a corrugated cardboard web 2 laminated on one side by means of the holding-transport units, which impart a holding action. The hitherto active corrugating apparatus pivots from its active position into its inactive position. When the hitherto active corrugating apparatus is pivoted from its active position in the direction of its parked position, a severing of the endless first material web is expediently performed. The hitherto inactive corrugating apparatus 87 pivots from its previous parked position into its active position.

Figure 21:
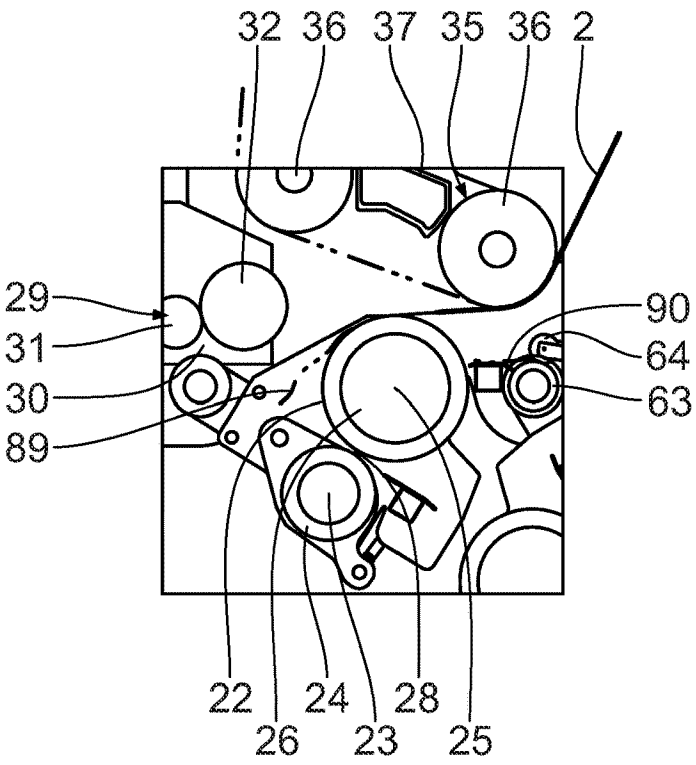
FIG. 21 is a view of a partial detail from FIG. 20, which shows a displacement of the hitherto active corrugating apparatus into its parked position.
Figure 22:
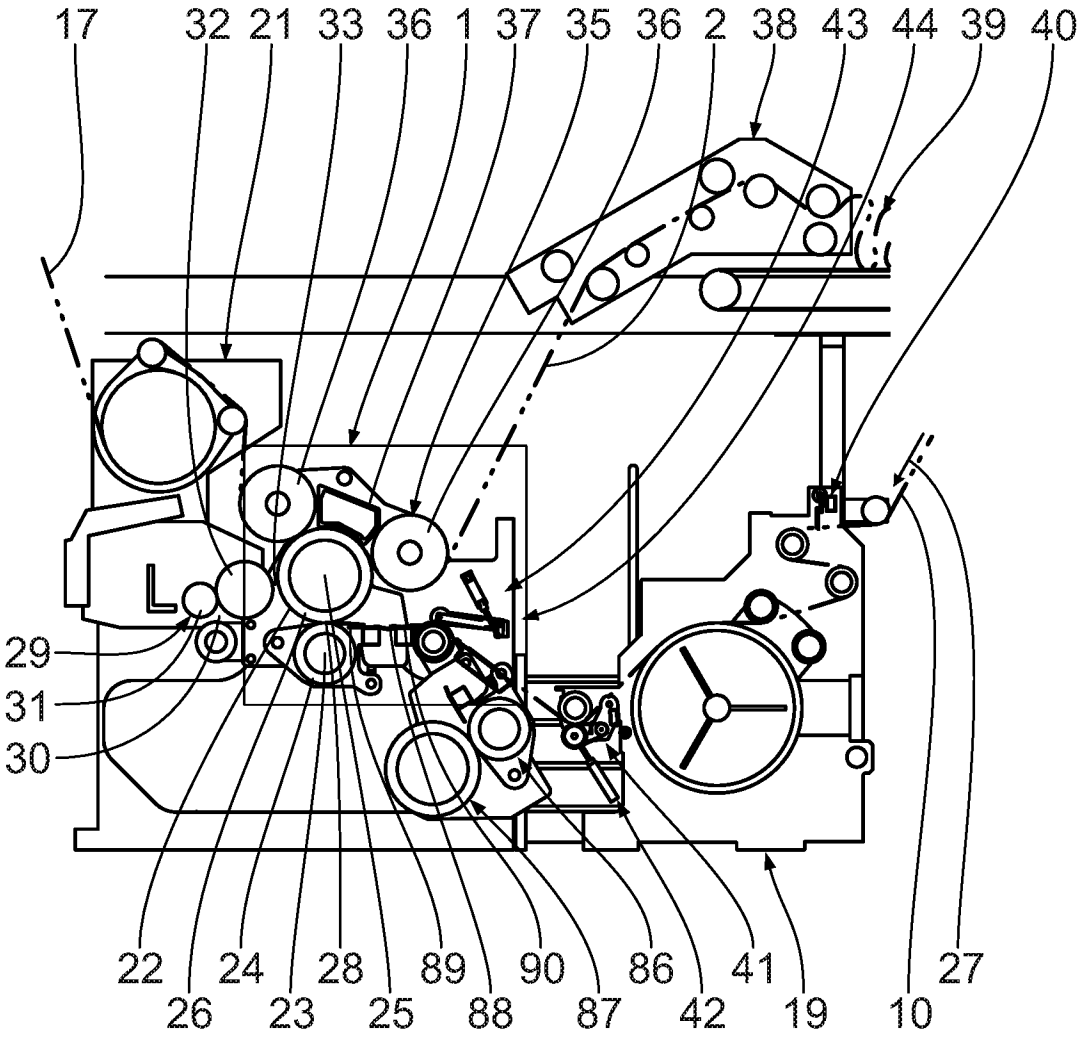
FIG. 22 is a partial view corresponding to FIG. 18, which illustrates an alternative severing process, wherein the units shown in FIGS. 8 to 12 and 13 to 17 are again situated in their respective holding position.
Figure 24:
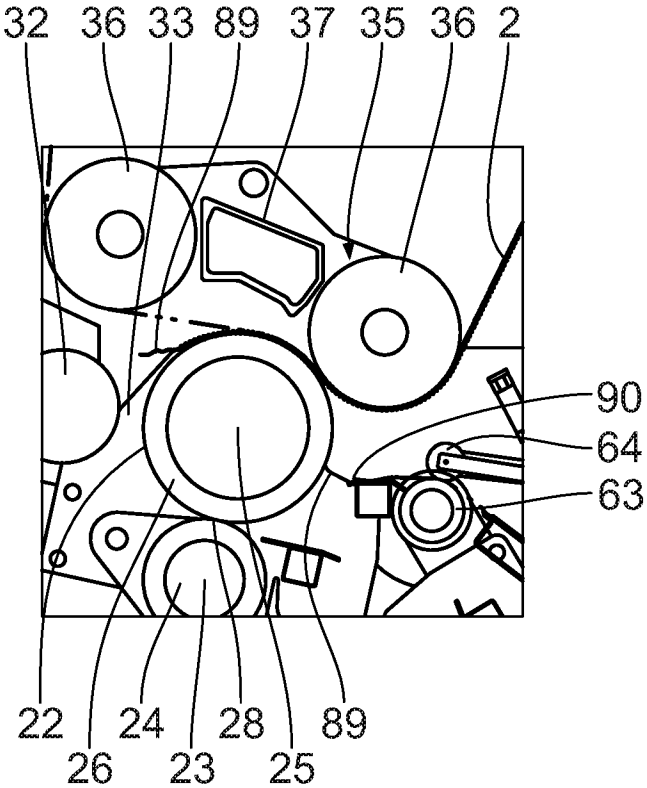
FIG. 24 is a view showing an empty running situation of the arrangement shown in FIG. 22 for producing a corrugated cardboard web laminated on one side.
Figure 23:
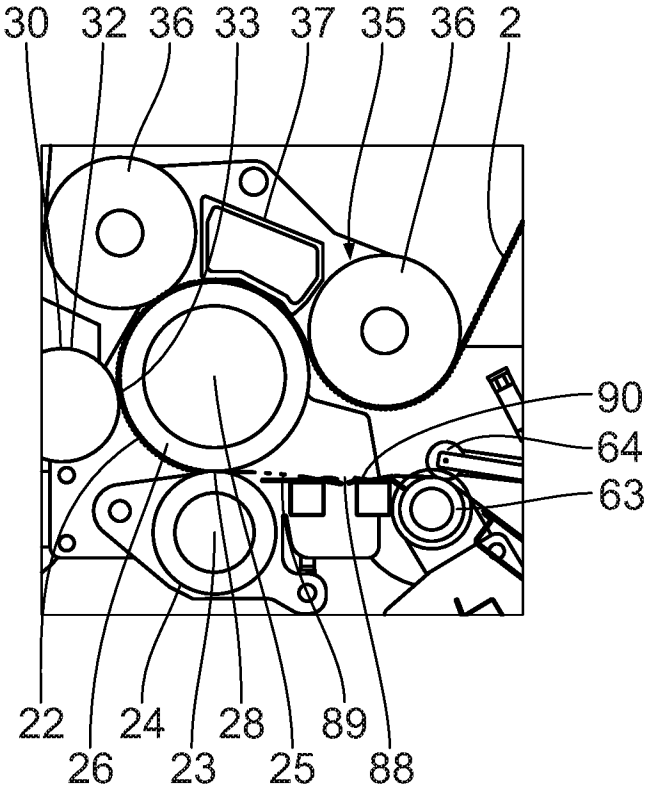
FIG. 23 is a view showing an empty running situation of the arrangement shown in FIG. 22 for producing a corrugated cardboard web laminated on one side.

As an alternative to the undefined tearing as per FIGS. 20 and 21, a severing of the endless first material web 10 is performed, as per FIGS. 22 to 24, by means of the severing apparatus 40, which may be designed in different ways, as already stated. In this case, too, the two holding-transport units hold the endless first material web 10 with an in particular predefined holding moment. The holding moments of the two holding-transport units may be identical or different. The hitherto active corrugating apparatus, in particular together with the upward transport apparatus 38, transports the endless first material web 10 onward, such that it tears at a predetermined location.

Figure 25:
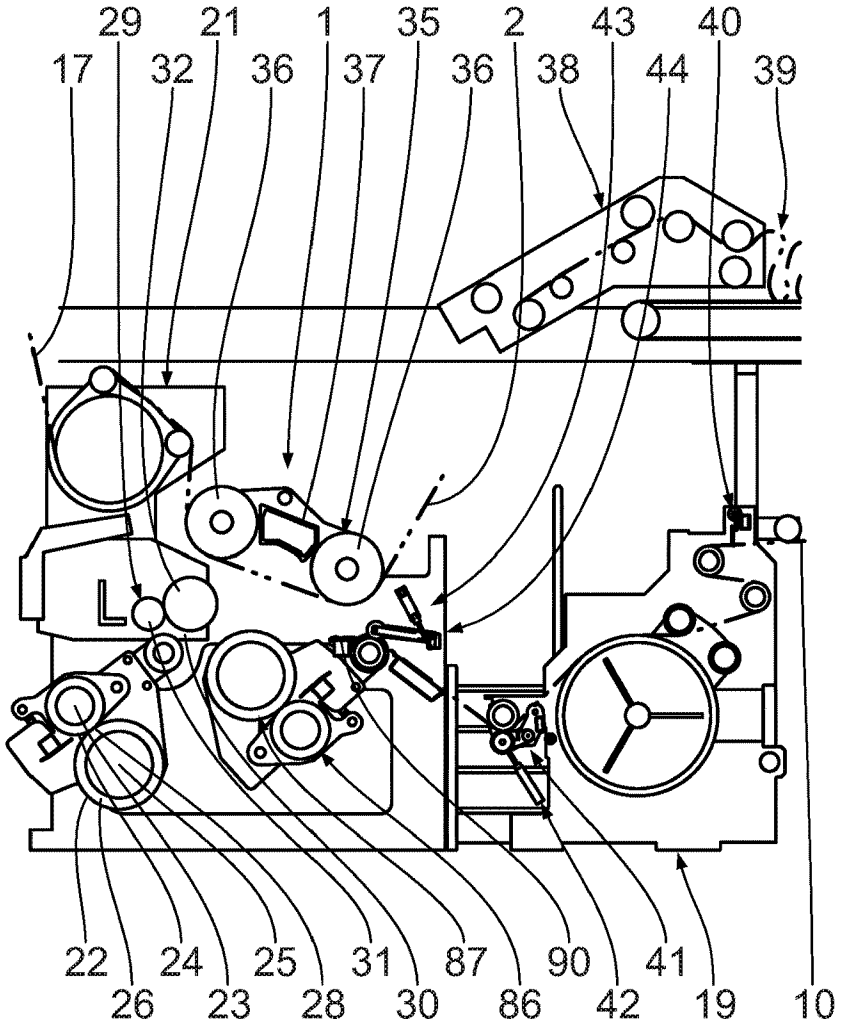
FIG. 25 is a partial view corresponding to FIG. 18, which illustrates a displacement of the hitherto inactive corrugating apparatus into the active corrugating position.

In FIG. 25, the hitherto active corrugating apparatus has been pivoted in the direction of its parked position. The hitherto inactive corrugating apparatus 87 has, by contrast, been pivoted from its previous parked position in the direction of the active position. The pressing belt module 35 is in this case at a standstill. The pressing belt 37 is stopped.

Figure 26:
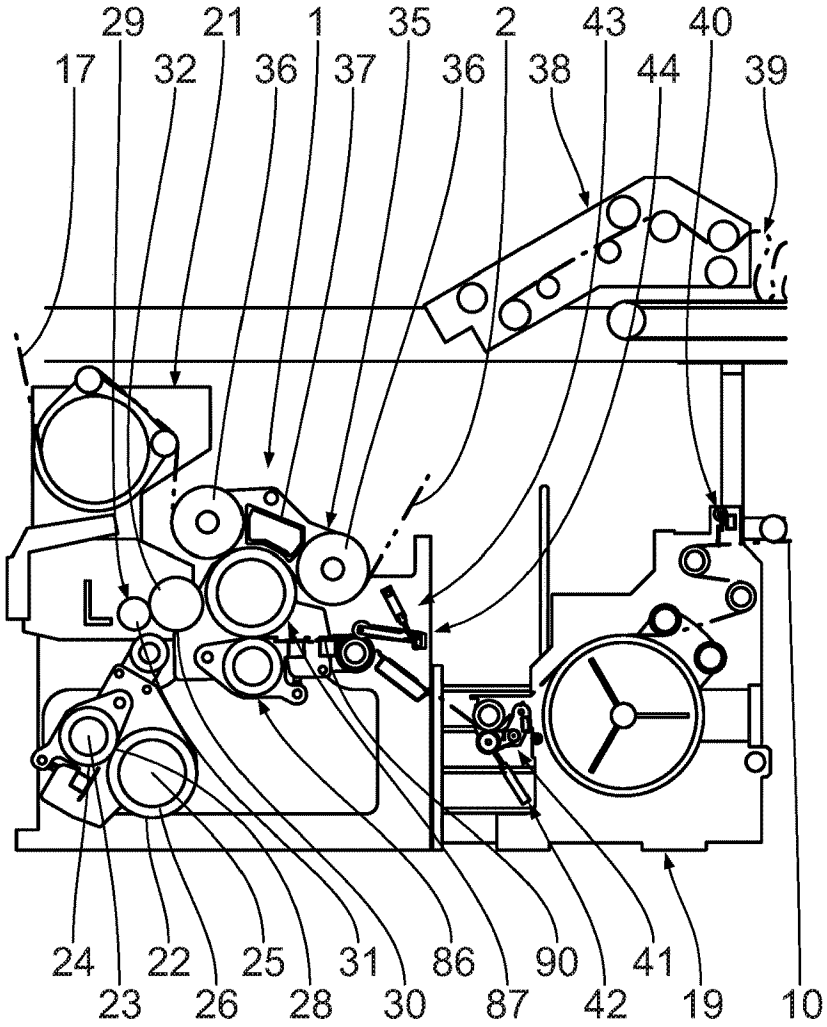
FIG. 26 is a partial view corresponding to FIG. 18, which shows a restart of the arrangement shown in FIG. 1 for producing a corrugated cardboard web laminated on one side.

In FIG. 26, the hitherto inactive corrugating apparatus 87 has been pivoted fully into its active position. The clamping transport roller arrangement 78 and the holding running roller 64 continue to lie against the endless first material web 10 and are now driven, such that, as a result, the trailing web section 90 of the endless first material web 10 is transported so as to be guided into the new corrugating apparatus 87. The holding-transport units are active, and are situated in their transport positions. During the run-in into the new corrugating apparatus 87, a freewheel is expediently used.

The holding-transport units are subsequently pivoted into their inactive positions again.

An alternative severing of the endless first material web 10 will be described below with reference to FIGS. 27 and 28.

Figure 27:
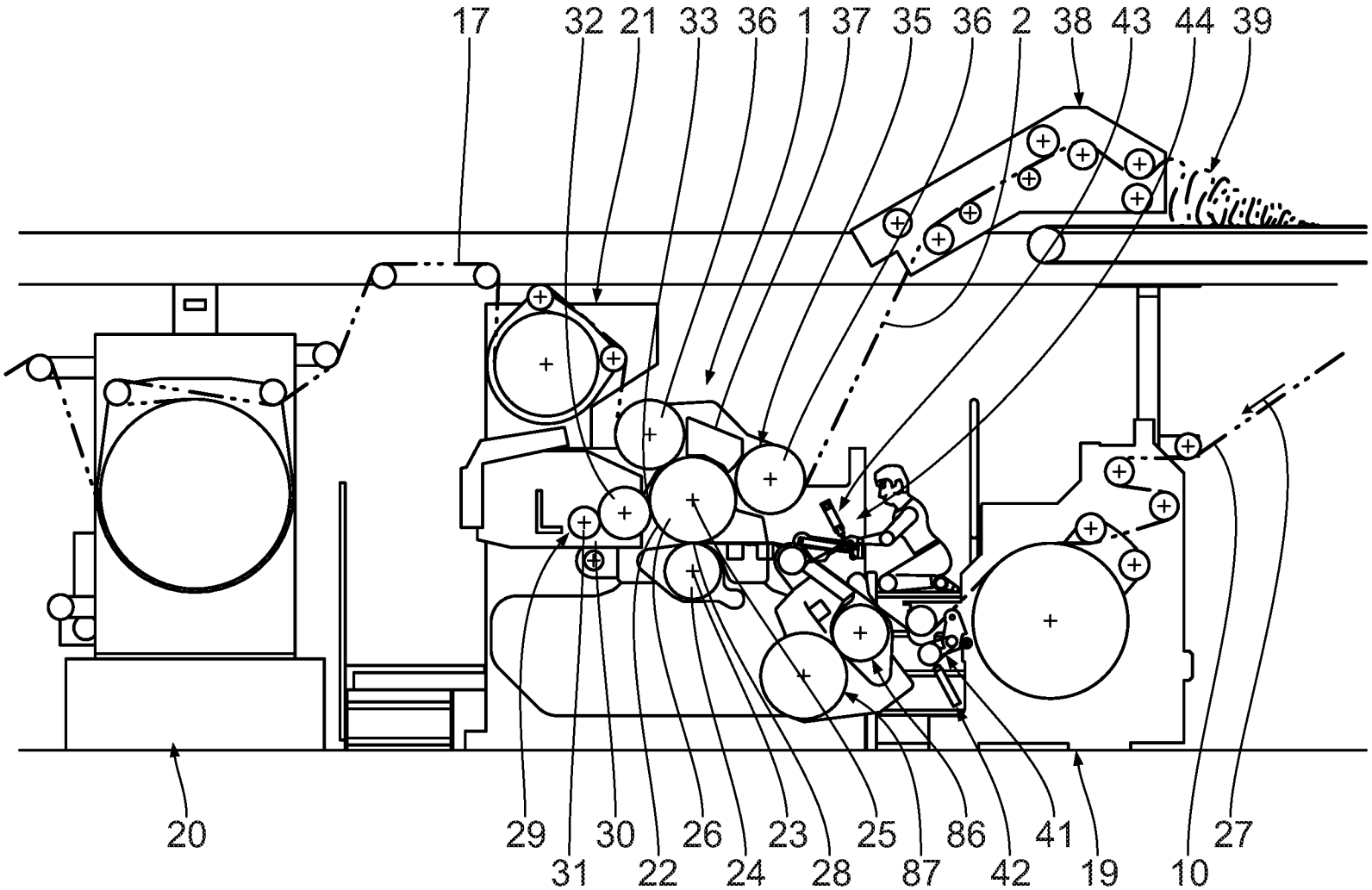
FIG. 27 is substantially a side view of an arrangement according to the invention for producing a corrugated cardboard web laminated on one side, said side view illustrating an alternative severing process of the first material web.
Figure 28:
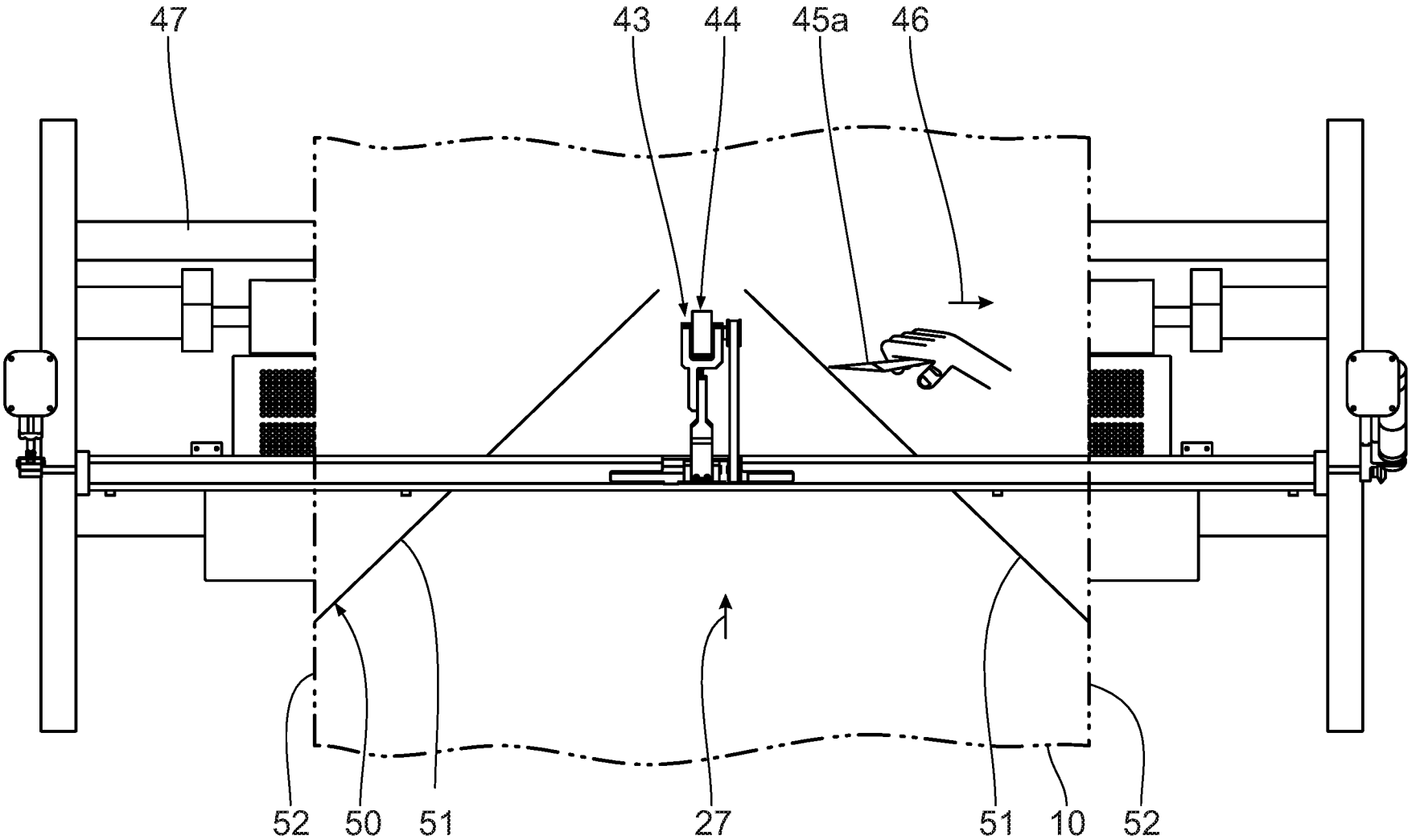
FIG. 28 is a view similar to FIG. 2, which further illustrates the severing process shown in FIG. 27.

The arrangement 1 illustrated in FIGS. 27, 28 for producing a corrugated cardboard web 2 laminated on one side is similar to the arrangement 1 shown in FIG. 1 for producing a corrugated cardboard web 2 laminated on one side. Said arrangement likewise has a first holding-transport unit composed of the first holding device 41 and the first transport device 42, which unit is assigned to the endless first material web 10. Said arrangement furthermore comprises a second holding-transport unit composed of the second holding device 43 and second transport device 44, which unit is positioned downstream of the first holding-transport unit and is expediently assigned to the endless first material web 10. The holding-transport units are positioned upstream of the active corrugating apparatus and arranged spaced apart from one another.

By contrast to the preceding embodiment, the arrangement 1 illustrated in FIGS. 27, 28 for producing a corrugated cardboard web 2 laminated on one side has no mechanical severing apparatus 40 arranged upstream of the active corrugating apparatus.

Here, the wedge-shaped cut 50 is generated manually by means of a cutter blade 45*a*, which is correspondingly guided by a machine operator and forms a severing element or a severing apparatus. The wedge-shaped cut 50 is formed by means of two manually generated oblique cuts 51, which obliquely converge from a respective longitudinal edge 52 of the endless first material web 10 in the transport direction 27, but end with a spacing to one another. The oblique cuts 51 are expediently generated, when the endless first material web 10 is stationary, adjacent to the second holding-transport unit manually by means of corresponding engagement of the cutter blade 45*a* into the first material web 10, wherein here, the second holding-transport unit is expediently situated in its active position or holding position. The endless first material web 10 is led through the active corrugating apparatus with the corrugating rolls 24, 26. Said endless first material web is led past the inactive corrugating apparatus 87.

While specific embodiments of the invention have been shown and described in detail to illustrate the application of the principles of the invention, it will be understood that the invention may be embodied otherwise without departing from such principles.

The invention claimed is:

1. A plant for producing corrugated cardboard, the plant comprising:

an arrangement for producing a corrugated cardboard web laminated on one side, the arrangement comprising:

a corrugating apparatus for generating a corrugated web, which has a corrugation, from a first material web;

a glue-applying apparatus for applying glue to tips of the corrugation of the corrugated web; and a pressing apparatus for pressing a top web onto the tips, provided with glue, of the corrugated web;

a severing apparatus arranged upstream of the corrugating apparatus and the severing apparatus being configured for at least regionally severing the first material web in a transverse direction thereof;

an actuatable holding apparatus positioned downstream of the severing apparatus and the actuatable holding apparatus being configured for holding a trailing web section, generated by the severing apparatus, of the first material web.

2. The plant as claimed in claim 1, wherein the severing apparatus comprises a severing device with at least two severing elements displaceable in the transverse direction of the first material web and the at least two severing element being configured for generating a wedge-shaped cut in the first material web.

3. The plant as claimed in claim 1, wherein the severing apparatus comprises a tear-off device for controlled tearing-off of the first material web.

4. The plant as claimed in claim 1, wherein the actuatable holding apparatus, in an active position, forming the severing apparatus, is capable of holding the first material web such that the first material web tears in the transverse direction.

5. The plant as claimed in claim 1, wherein the actuatable holding apparatus is configured for immobilizing the first material web with clamping action.

6. The plant as claimed in claim 1, wherein the actuatable holding apparatus is displaceable between an inactive position and an active position.

7. The plant as claimed in claim 1, further comprising a corrugating apparatus changeover apparatus for changing over the corrugating apparatus.

8. The plant as claimed in claim 7, wherein, prior to a changeover of the corrugating apparatus, a trailing web section, generated by the severing apparatus, of the first material web is held by the actuatable holding apparatus positioned downstream of the severing apparatus and configured for holding a trailing web section, generated by the severing apparatus, of the first material web.

9. The plant as claimed in claim 8, wherein the changeover of the corrugating apparatus is performed by the corrugating apparatus changeover apparatus.

10. The plant as claimed in claim 7, wherein the corrugating apparatus changeover apparatus comprises at least one inactive corrugating apparatus for replacing the corrugating apparatus.

11. The plant as claimed in claim 1, further comprising a transport apparatus positioned downstream of the severing apparatus and the transport apparatus being configured for transporting a trailing web section, generated by the severing apparatus, of the first material web to the corrugating apparatus.

12. The plant as claimed in claim 11, wherein the transport apparatus comprises at least one driveable transport element for transporting the trailing web section, generated by the severing apparatus, of the first material web into the corrugating apparatus.

13. The plant as claimed in claim 12, wherein the at least one driveable transport element is formed as a running roller.

14. The plant as claimed in claim 13, wherein the running roller has a freewheel which engages when the corrugated web is gripped by the corrugating apparatus.

15. The plant as claimed in claim 11, wherein the transport apparatus comprises a first transport device and a second transport device, arranged spaced apart from the first transport device, for transporting the trailing web section, generated by the severing apparatus, of the first material web to the corrugating apparatus.

16. The plant as claimed in claim 1, wherein the actuatable holding apparatus and a transport apparatus positioned downstream of the severing apparatus and the transport apparatus being configured for transporting a trailing web section, generated by the severing apparatus, of the first material to the corrugating apparatus, together form a holding-transport apparatus for at least one of holding and transporting the trailing web section, generated by the severing apparatus, of the first material web.

17. The plant as claimed in claim 16, wherein a first holding device of the actuatable holding apparatus and a first transport device of the transport apparatus form a first holding-transport unit for at least one of holding and transporting the trailing web section, generated by the severing apparatus, of the first material web.

18. The plant as claimed in claim 17, wherein a second holding device of the holding apparatus and a second transport device of the transport apparatus form a second holding-transport unit for at least one of holding and transporting the trailing web section, generated by the severing apparatus, of the first material web.

19. The plant as claimed in claim 1, wherein the actuatable holding apparatus comprises a first holding device and a second holding device, arranged spaced apart from the first holding device, for holding the trailing web section, generated by the severing apparatus, of the first material web.

20. An arrangement for producing a corrugated cardboard web laminated on one side, as a constituent part of a plant for producing corrugated cardboard, the arrangement comprising:

a corrugating apparatus for generating a corrugated web, which has a corrugation, from a first material web;

a glue-applying apparatus for applying glue to tips of the corrugation of the corrugated web;

a pressing apparatus for pressing a top web onto the tips, provided with glue, of the corrugated web;

a severing apparatus arranged upstream of the corrugating apparatus and the severing apparatus is configured for at least regionally severing the first material web in a transverse direction thereof;

an actuatable holding apparatus positioned downstream of the severing apparatus and the actuatable holding apparatus being configured for holding a trailing web section, generated by the severing apparatus, of the first material web.

21. An arrangement for producing a corrugated cardboard web laminated on one side, as a constituent part of a plant for producing corrugated cardboard, the arrangement comprising:

a corrugating apparatus for generating a corrugated web, which has a corrugation, from a first material web;

a glue-applying apparatus for applying glue to tips of the corrugation of the corrugated web;

a pressing apparatus for pressing a top web onto the tips, provided with glue, of the corrugated web;

a severing apparatus arranged upstream of the corrugating apparatus and the severing apparatus is configured for at least regionally severing the first material web in a transverse direction thereof;

an actuatable holding apparatus positioned downstream of the severing apparatus and the actuatable holding apparatus being configured for holding a trailing web section, generated by the severing apparatus, of the first material web, the actuatable holding apparatus being configured for immobilizing the first material web with clamping action, the actuatable holding apparatus being displaceable between an inactive position and an active position.

* * * * *